US005227842A

United States Patent [19]

Hayashi et al.

[11] Patent Number: 5,227,842

[45] Date of Patent: Jul. 13, 1993

[54] ELECTROPHOTOGRAPHIC IMAGE FORMING APPARATUS WHICH CONTROLS DEVELOPER BIAS BASED ON IMAGE IRREGULARITY

[75] Inventors: Kouji Hayashi; Takashi Bisaiji; Norimitsu Kikuchi, all of Yokohama; Takeyoshi Sekine, Tokyo; Noboru Sawayama, Tokyo; Takayuki Maruta, Tokyo; Tetsuro Miura, Tokyo; Kazunori Bannai, Tokyo; Kazunari Yamada, Tokyo; Nobuhiro Nakayama, Susono, all of Japan

[73] Assignee: Ricoh Company, Ltd., Tokyo, Japan

[21] Appl. No.: 855,092

[22] Filed: Mar. 20, 1992

[30] Foreign Application Priority Data

Mar. 20, 1991 [JP] Japan ..... 3-057249
Jan. 29, 1992 [JP] Japan ..... 4-040186

[51] Int. Cl.[5] ..... G03G 21/00
[52] U.S. Cl. ..... 355/208; 355/245
[58] Field of Search ..... 355/246, 245, 203, 204, 355/208, 210, 261, 265, 205, 207

[56] References Cited

U.S. PATENT DOCUMENTS 4,277,162 7/1981 Kasahara et al. ..... 355/246
4,632,537 12/1986 Imai ..... 355/203
4,693,592 9/1987 Kurpan ..... 355/208
4,894,685 1/1990 Shoji ..... 355/246
5,060,013 10/1991 Spence ..... 355/208
5,103,260 4/1992 Tompkins et al. ..... 355/208

*Primary Examiner*—A. T. Grimley
*Assistant Examiner*—Sandra L. Brasé
*Attorney, Agent, or Firm*—Oblon, Spivak, McClelland, Maier & Neustadt

[57] ABSTRACT

An image forming apparatus having a developing device of the type using a two-component type developer and developing an electrostatic latent image by a bias electric field having an alternating electric field. A predetermined reference latent image is electrostatically formed on an image carrier by a reference latent image forming device and then developed by the developing device to become a reference toner image. An irregularity detecting circuit determines the degree of difference between the density of the edge and the density of the central portion of the reference toner image. A bias electric field control circuit controls the bias electric field in matching relation to the output of the irregularity detecting circuit, thereby preventing the image quality from being degraded by a change in the resistance of the carrier.

18 Claims, 28 Drawing Sheets

ELECTROPHOTOGRAPHIC IMAGE FORMING APPARATUS WHICH CONTROLS DEVELOPER BIAS BASED ON IMAGE IRREGULARITY

BACKGROUND OF THE INVENTION

The present invention relates to a facsimile transceiver, printer or similar image forming apparatus.

An image forming apparatus of the type using an electrophotographic copying or image recording process, for example, electrostatically forms a latent image on a photoconductive element or similar image carrier and then develops it by a developing device to produce a toner image. It has been customary with this type of apparatus to fix the toner image directly on the image carrier, or to transfer the toner image from the image carrier to a recording medium, e.g., a paper sheet and then fix it on the paper sheet, or to transfer the toner image from the image carrier to a transfer belt or similar intermediate transfer body and then from the intermediate transfer body to a recording medium to fix it on the recording medium. Conventional developing devices for the above application include one which uses a two-component type developer, i.e., a mixture of toner and carrier and forms a bias electric field for development having an alternating electric field in a developing region where a developer carrier thereof faces the image carrier. In an image forming apparatus with this kind of developing device, the frequency of the alternating electric field may be changed in matching relation to the kind of a document, as disclosed in Japanese Patent Laid-Open Publication (Kokai) No. 116365/1982. Alternatively, the frequency of the alternating electric field may be changed in association with the spatial frequency of a document, as proposed in Japanese Patent Laid-Open Publication No. 42070/1983. Further, the bias electric field may be controlled on the basis of the ambient conditions, as taught in Japanese Patent Laid-Open Publication No. 186369/1990.

However, by repetitively forming an image while observing the changes in image quality due to aging, we found that the image forming apparatus having a developing device of the type using a two-component type developer and developing a latent image by forming a bias electric field having an alternating electric field in a developing region has the following problems left unsolved. The degree of edge emphasis, e.g., the occurrence that the image density is higher at the edges than at the central portion is aggravated due to aging, resulting in poor image quality. It also occurs that the image density is lower at the edges than at the central portion and, in addition, the reproduced image has an undulatory contour, preventing the image from having sharpness. Either of the edge emphasis and the fall of sharpness is apt to occur, depending on the kind of carrier used.

Edge emphasis rarely occurs when a latent image is developed by a two-component type developer including a conductive carrier, while it is apt to occur when use is made of a two-component type developer including an insulative carrier having a higher resistance than the conductive carrier, as well known in the art. A conductive carrier, for example, renders the developing characteristic flat relative to the frequency of a latent image without accentuating particular frequencies. By contrast, an insulative carrier accentuates particular frequencies, i.e., edges. It is also known that the resistance of the carrier increases when the toner firmly adheres to the surface of the carrier due to aging, i.e., the carrier is spent. We, therefore, assumed that the edge emphasis due to aging is aggravated by the increase in the resistance of the carrier due to aging and conducted a series of experiments for determining the relation between the resistance of the carrier and the degree of edge emphasis by using carriers each having a particular resistance. The experiments showed that the degree of emphasis increases with the increase in the resistance of the carrier. On the other hand, it has been reported that films coating the insulative carrier are shaved off due to aging to lower the resistance of the carrier. This led us to a conclusion that the fall of sharpness due to aging results from the decrease in the resistance of the carrier due to aging.

By extended experiments and studies, we found that the edge emphasis and the fall of sharpness have a correlation with the peak-to-peak voltage and frequency of an AC component included in a voltage which is applied to a developing sleeve or similar counter electrode member, and that the peak-to-peak voltage and frequency each has an adequate range for producing an attractive image free from edge emphasis and the fall of sharpness. We further found that such adequate ranges depend on the resistance of the carrier. In addition, we found that the above-stated fall of sharpness occurs when the peak-to-peak voltage and the frequency are higher than the respective adequate ranges.

From the above, it follows that the peak-to-peak voltage and the frequency for minimizing edge emphasis and the fall of sharpness are brought out of their adequate ranges due to the change in the resistance of the carrier due to aging, sequentially lowering the image quality as a result of edge emphasis and the fall of sharpness.

SUMMARY OF THE INVENTION

It is, therefore, an object of the present invention to provide an image forming apparatus using the above-described type of developing means and capable of insuring desirable image quality despite the changes in the resistance of a carrier.

In accordance with the present invention, an image forming apparatus comprises an image carrier, a latent image forming device for electrostatically forming a latent image on the image carrier, a developing device for conveying a two-component type developer made up of a toner and a carrier to a developing region where a developer carrier faces the image carrier by the developer carrier, and forming a bias electric field for development having an alternating electric field in the developing region to convert the latent image to a toner image, a reference latent image forming device for forming a predetermined reference latent image on the image carrier, an irregularity detecting circuit for detecting, after the developing device has developed the reference latent image to produce a reference toner image, a degree of difference in density between an edge and a central portion of the reference toner image, and a bias electric field control circuit for controlling the bias electric field in response to an output of the irregularity detecting device.

Also, in accordance with the present invention, an image forming apparatus comprises an image carrier, a latent image forming device for electrostatically forming a latent image on the image carrier, a developing device for conveying a two-component type developer made up of a toner and a carrier to a developing region where a developer carrier faces the image carrier by the developer carrier, and forming a bias electric field for development having an alternating electric field in the developing region to convert the latent image to a toner image, a reference latent image forming device for forming a predetermined reference latent image on the image carrier, a reference toner image detecting circuit for detecting the size of a reference toner image which the developing device has produced by developing the reference latent image, and a bias electric field control circuit for controlling the bias electric field in response to the reference toner image detecting circuit.

Further, in accordance with the present invention, an image forming apparatus comprises an image carrier, a latent image forming device for electrostatically forming a latent image on the image carrier, a developing device for conveying a two-component type developer made up of a toner and a carrier to a developing region where a developer carrier faces the image carrier by the developer carrier, and forming a bias electic field for development having an alternating electric field to convert the latent image to a toner image, a deterioration detecting circuit for detecting a degree of deterioration of the developer, and a bias electric field control circuit for controlling the bias electric field in response to the deterioration detecting circuit.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1A:
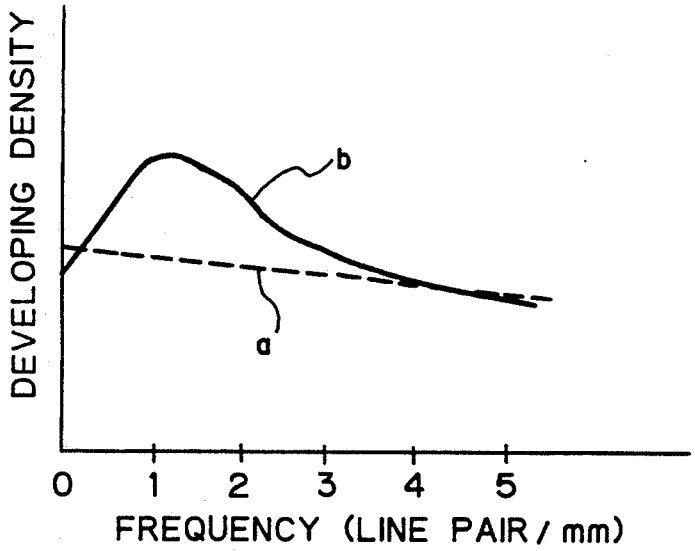
FIG. 1A is a graph indicative of a difference of developing characteristics ascribable to the kind of a carrier.
Figure 1B:
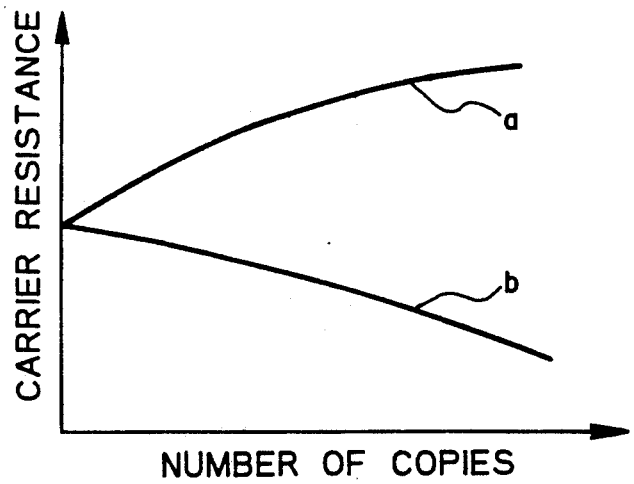
FIG. 1B is a graph showing the varying resistance of a carrier due to aging.
Figure 1C:
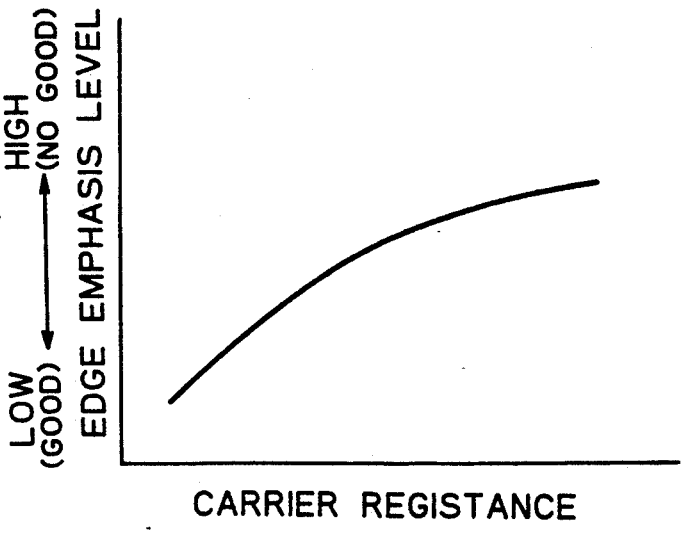
FIG. 1C is a graph showing a correlation between the carrier resistance and the edge emphasis.

To better understand the present invention, the background of the present invention will be described more specifically. Assume an image forming apparatus having a developing device of the type using a two-component developer and developing a latent image by forming a bias electric field having an alternating electric field in a developing region. Edge emphasis rarely occurs when a latent image is developed by a two-component type developer including a conductive carrier, while it is apt to occur when use is made of a two-component type developer including an insulative carrier having a higher resistance than the conductive carrier, as well known in the art. FIG. 1A shows curves a and b each showing a specific relation between the developing density and the frequency of a latent image. As the curve a indicates, the conductive carrier renders the developing characteristic flat relative to the frequency of a latent image without accentuating particular frequencies. By contrast, as the curve b shows, the insulative carrier accentuates particular frequencies, i.e., edges. It is also known that the resistance of the carrier increases when the toner firmly adheres to the surface of the carrier due to aging, i.e., the carrier is spent, as indicated by a curve a in FIG. 1B. We, therefore, assumed that the edge emphasis due to aging is aggravated by the increase in the resistance of the carrier due to aging and conducted a series of experiments for determining the relation between the resistance of the carrier and the degree of edge emphasis by using carriers each having a particular resistance. The experiments showed that the degree of emphasis increases with the increase in the resistance of the carrier, as shown in FIG. 1C. On the other hand, it has been reported that films coating the insulative carrier are shaved off due to aging to lower the resistance of the carrier, as indicated by a curve b in FIG. 1B. This led us to a conclusion that the fall of sharpness due to aging results from the decrease in the resistance of the carrier due to aging.

Figure 2A:
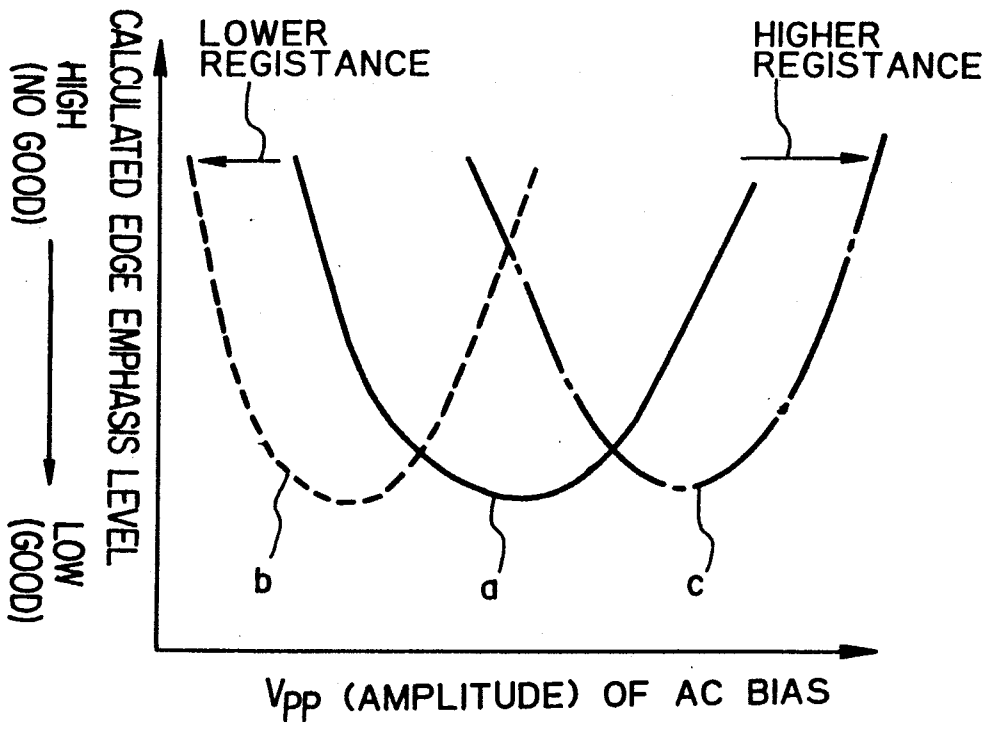
FIG. 2A is a graph showing a correlation between the edge emphasis an the peak-to-peak voltage of bias voltage for development.
Figure 2B:
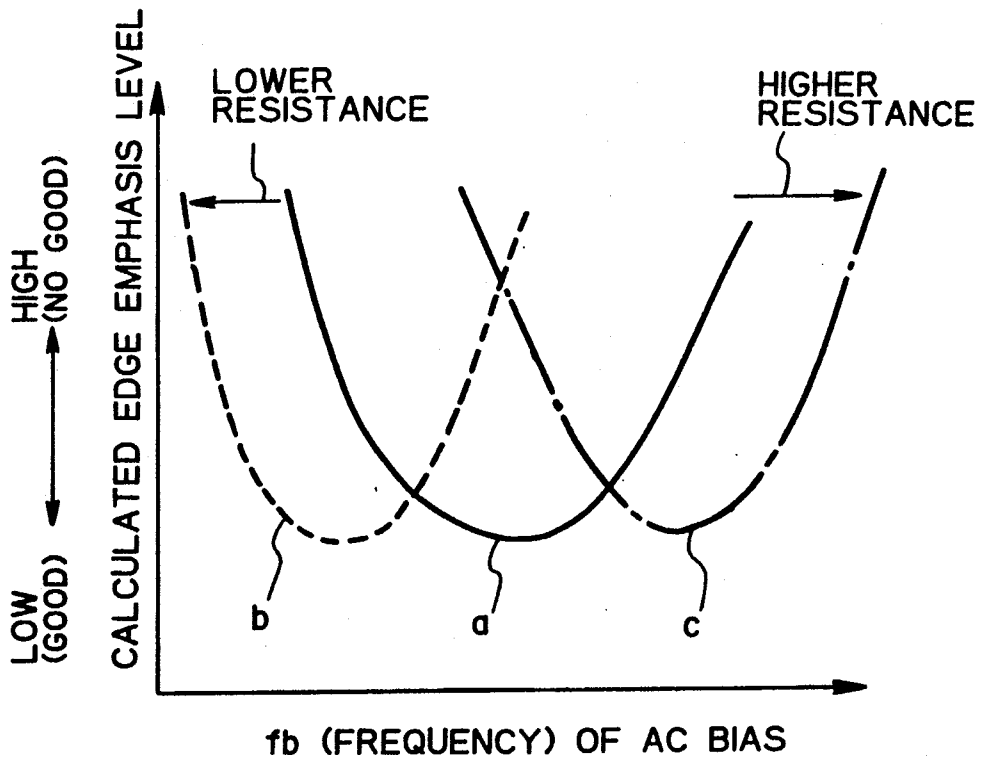
FIG. 2B is a graph showing a correlation between the edge emphasis and the frequency of the bias voltage.

By extended experiments and studies, we found that the edge emphasis and the fall of sharpness have a correlation with the peak-to-peak voltage and frequency of an AC component included in a voltage which is applied to a developing sleeve or similar counter electrode member, and that the peak-to-peak voltage and frequency each has an adequate range for producing an attractive image free from edge emphasis and the fall of sharpness. We further found that such adequate ranges depend on the resistance of the carrier. For example, FIG. 2A shows a correlation between the peak-to-peak voltage and the degree of edge emphasis with respect to each of a fresh carrier a, a carrier b whose resistance has been lowered due to use, and a carrier c whose resistance has been increased due to use. In FIG. 2A, the abscissa and the ordinate indicate respectively the peak-to-peak voltage (Vpp of AC bias) and the degree of edge emphasis. It will be seen from the graph that as the resistance of the carrier increases, the peak-to-peak voltage for producing an attractive image with a minimum of edge emphasis increases. FIG. 2B shows a correlation between the frequency and the degree of edge emphasis with respect to each of the carriers a, b and c; the abscissa and the ordinate indicate respectively the frequency (fb of AC bias) and the degree of edge emphasis. As FIG. 2B indicates, the frequency for achieving a desirable image with a minimum of edge emphasis increases with the resistance of the carrier. In addition, we found that the above-stated fall of sharpness occurs when the peak-to-peak voltage and the frequency are higher than the respective adequate ranges.

From the above, it follows that the peak-to-peak voltage and the frequency for minimizing edge emphasis and the fall of sharpness are brought out of their adequate ranges due to the change in the resistance of the carrier due to aging, sequentially lowering the image quality as a result of edge emphasis and the fall of sharpness.

Figure 3:
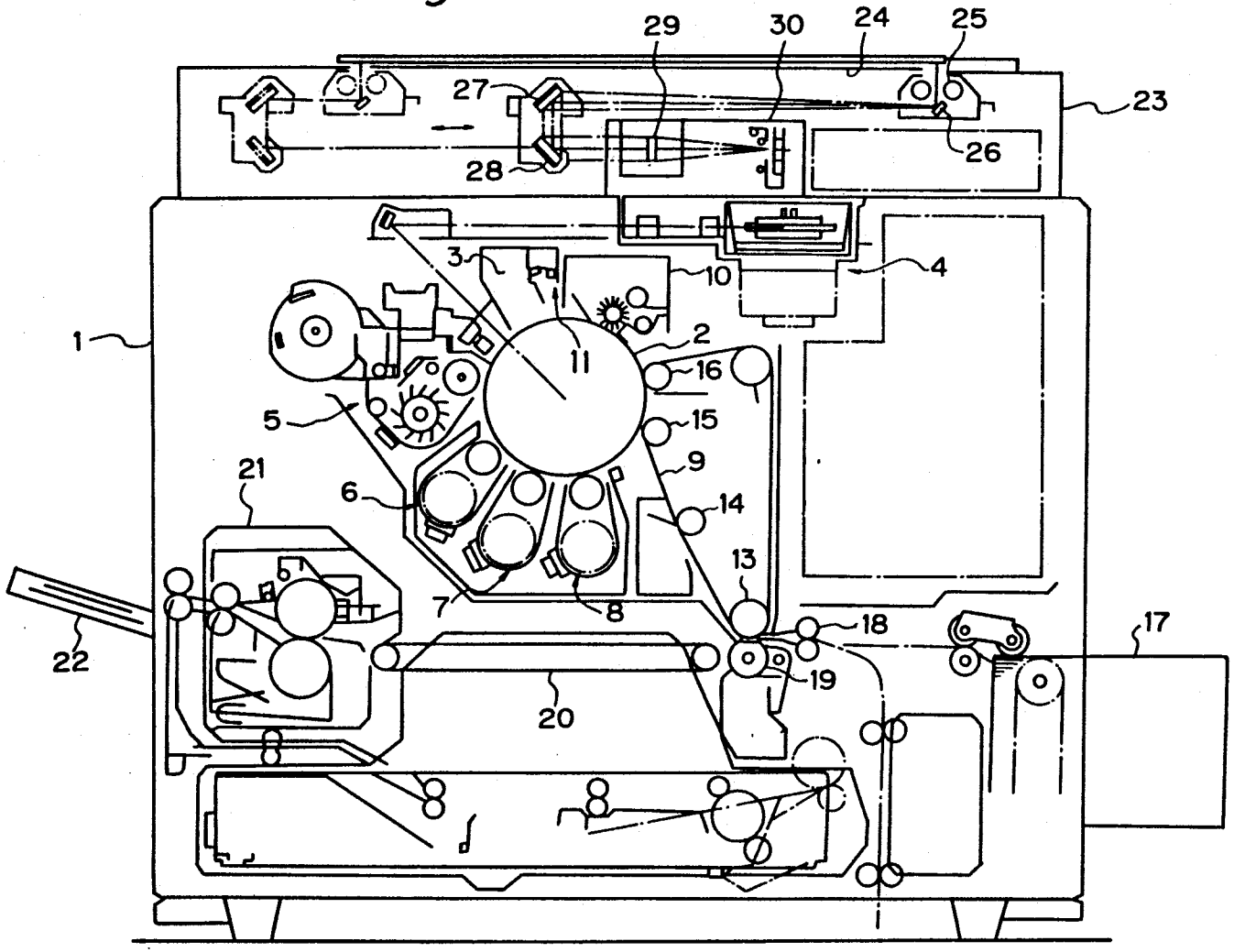
FIG. 3 is a view showing the general construction of an image forming apparatus embodying the present invention.

Referring to FIG. 3, an image forming apparatus embodying the present invention is shown and implemented as a electrophotographic color copier by way of example. As shown, the copier has an image carrier in the form of an organic photoconductive drum 2 at substantially the center thereof. The drum 2 has a diameter of 120 millimeters. Arranged around the drum 2 are a main charger 3, laser optics 4, a black developing unit 5, color developing units 6–8, a transfer belt 9 playing the role of an intermediate image transfer body, a cleaning unit 10, and a charge removing section 3. The transfer belt 9 is passed over rollers 12–16. A transfer voltage is applied to the transfer belt 9 from a transfer voltage source via bias rollers 15 and 16. The main charger 3 and laser optics 4 constitute latent image forming means in combination. The developing units 5–8 constitute developing means. While the drum 2 is rotated by a drive mechanism, not shown, the main charger 3 uniformly charges the surface of the drum 2. A laser beam issuing from the laser optics 4 exposes the charged surface of the drum 2 imagewise to thereby electrostatically form a latent image on the drum 2. Specifically, the laser optics 4 modulates a semiconductor laser by, for example, a black image signal, and an optical deflector steers the resulting beam from the laser to electrostatically form a black latent image on the drum 2. The black developing unit 5 develops the latent image by a two-component type developer, i.e., a mixture of black toner and carrier, thereby producing a black toner image. The black toner image is transferred from the drum 2 to the transfer belt 9. Thereafter, the cleaning device 10 removes the toner remaining on the drum 2, and then the charge removing section 11 dissipates the charge remaining on the drum 2. The drum 2 is now ready to form the next image thereon.

A yellow toner image and a magenta toner image are each formed and transferred in the same manner as the black image. Regarding a yellow toner image, the laser optics 4 modulates the semiconductor laser by a yellow image signal while the optical deflector steers the resulting laser beam to scan the drum 2 to thereby form a yellow latent image on the drum 2. The yellow developing unit 6 develops the yellow latent image by a two-component type developer made up of a yellow toner and a carrier, and the resulting yellow toner image is transferred to the transfer belt 9. Likewise, the laser optics 4 modulates the semiconductor laser by a magenta image signal, and the optical deflector deflects the resulting laser beam to scan the drum 2 to thereby form a magenta latent image on the drum 2. The magenta developing device 7 develops the magenta latent image by a two-component type developer made up of a magenta toner and a carrier so as to produce a magenta toner image. The magenta toner image is also transferred to the transfer belt 9. This is also true with a cyan image except that the laser optics 4 modulates the semiconductor laser by a cyan image signal, and that the cyan developing unit 8 develops a cyan latent image by a mixture of cyan toner and carrier.

In a monocolor copy mode, one of a black toner image, yellow toner image, magenta toner image and cyan toner image is formed and transferred. A recording sheet or paper sheet is fed from a paper feeding unit 17 to a register roller 18. The register roller 18 drives the paper sheet toward the transfer belt 9 such that the leading edge of the paper sheet meets that of the toner image existing on the belt 9. After the toner image has been transferred from the transfer belt 9 to the paper sheet by the bias roller 19, the paper sheet is separated from the belt 9. Then, the paper sheet is transported to a fixing unit 21 by a transport belt 20 to have the toner image fixed thereon by heat and pressure. Finally, the paper sheet, or monocolor copy, is driven out to a tray 22.

In a color copy mode using two or more colors, two or more of a black toner image, yellow toner image, magenta toner image and cyan toner image are formed and transferred one after another. Such toner images are sequentially transferred to the transfer belt 9 one above another to form a color image. The color image, like the monocolor image, is transferred to the transfer belt 9 and then to a paper sheet also fed from the paper feed unit 17 by way of the register roller 18. This is followed by the same procedure as described above in relation to a monocolor copy.

A document reading device 23 is mounted on the top of the copier body 1 and includes a glass platen 23 and a lamp 25. As the lamp 25 illuminates a document laid on the glass platen 23, an imagewise reflection from the document is routed through mirrors 26–28 and a lens 29 to a CCD (Charge Coupled Device) image sensor 30 to undergo photoelectric conversion. The lamp 25 and mirrors 26–28 move integrally with each other to scan the document while the image sensor 30 generates red, green and blue image signals. The three color image signals are processed by an image processor, not shown, to become yellow, magenta and cyan image signals. Theses signals are sequentially and selectively fed to the laser optics 4 to modulate the semiconductor laser.

Figure 4:
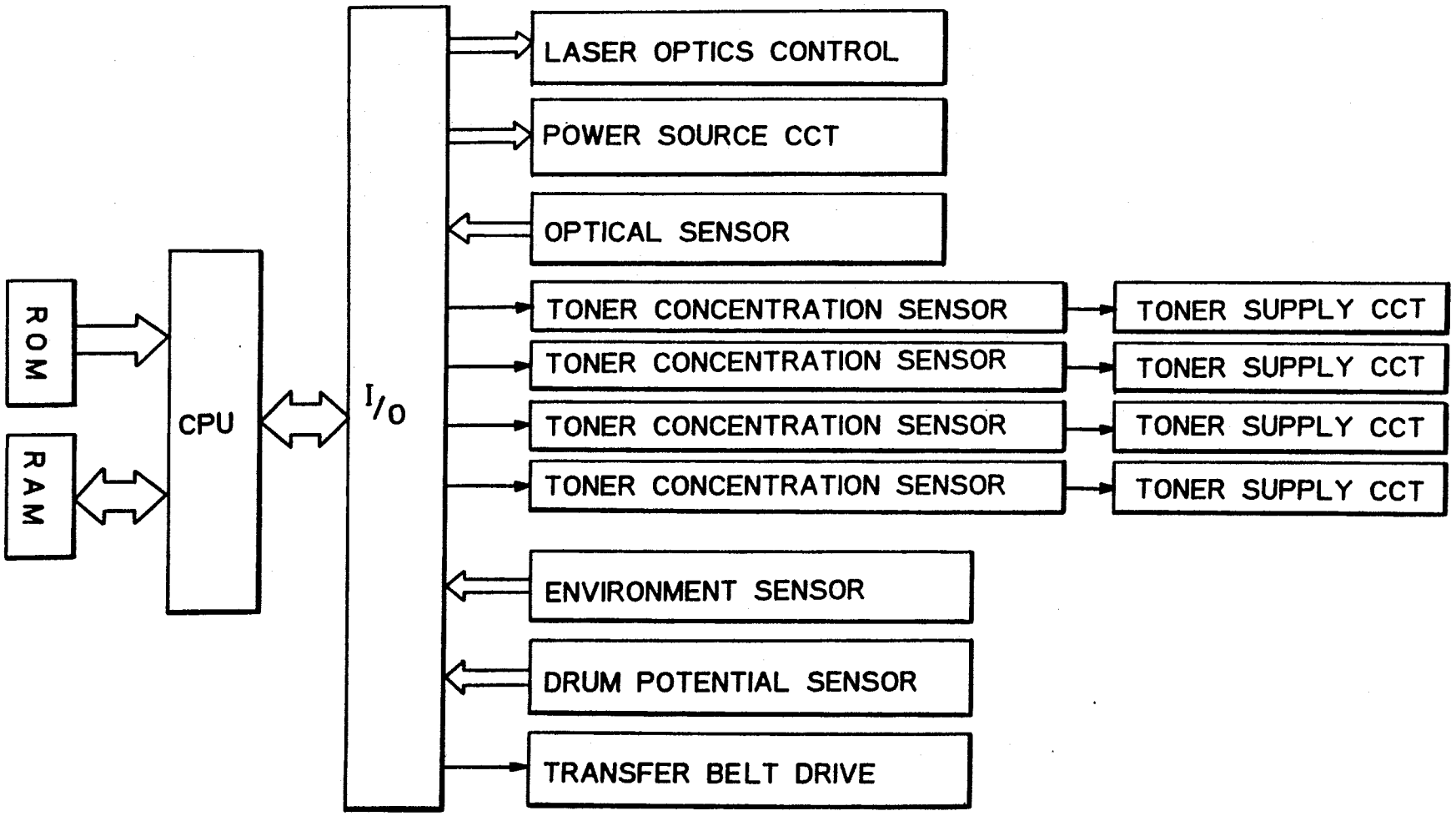
FIG. 4 is a block diagram schematically showing a control system incorporated in the embodiment.

FIG. 4 shows a control system incorporated in the copier having the above construction. As shown, the control system includes a main controller implemented by a CPU 31, and a ROM (Read Only Memory) 131 and a RAM (Random Access Memory) 132 associated with the CPU 31. A laser optics control section 35, a power source circuit 36, an optical sensor 37, toner concentration sensors 38B, 38Y, 38M and 38C, an environment sensor 39, a drum potential sensor 40, and a transfer belt drive section 41 are connected to the CPU 31 via an input/output (I/O) interface 34. The laser optics control section 35 regulates the output of the semiconductor laser included in the laser optics 4. The power source circuit 36 applies a predetermined discharge voltage to the main charger 3, applies a bias voltage for development to the developing units 5–8, and applies a predetermined transfer voltage to the bias rollers 15 and 16 and transfer bias roller 19. The optical sensor 37 is constituted by a light emitting diode or similar light emitting element and a phototransistor or similar light-sensitive element and located in close proximity to the drum 2 in a region downstream of an image transfer position and upstream of a cleaning position. The optical sensor 37 measures the amount of toner deposited on a reference toner pattern for detection formed on the drum 2 and the amount of toner deposited on the background with each of the toners of different colors. The toner concentration sensors 38B, 38Y, 38M and 38C each determines the toner concentration of the developer existing in associated one of the developing units 5–8 in terms of magnetic permeability, compares the toner concentration with a reference value, and feeds, when the former is lower than the latter, a toner supply signal representative of the shortage to associated one of toner supply circuits 42B, 42Y, 42M and 42C. In response, the toner supply circuit 42B, 42Y, 42M or 42C drives a toner supply section included in associated one of the developing units 5–8 to cause it to supply a fresh toner to the developer. The drum potential sensor 40 senses the surface potential of the drum 2 while the transfer belt drive section 41 drives the transfer belt 9.

Figure 5:
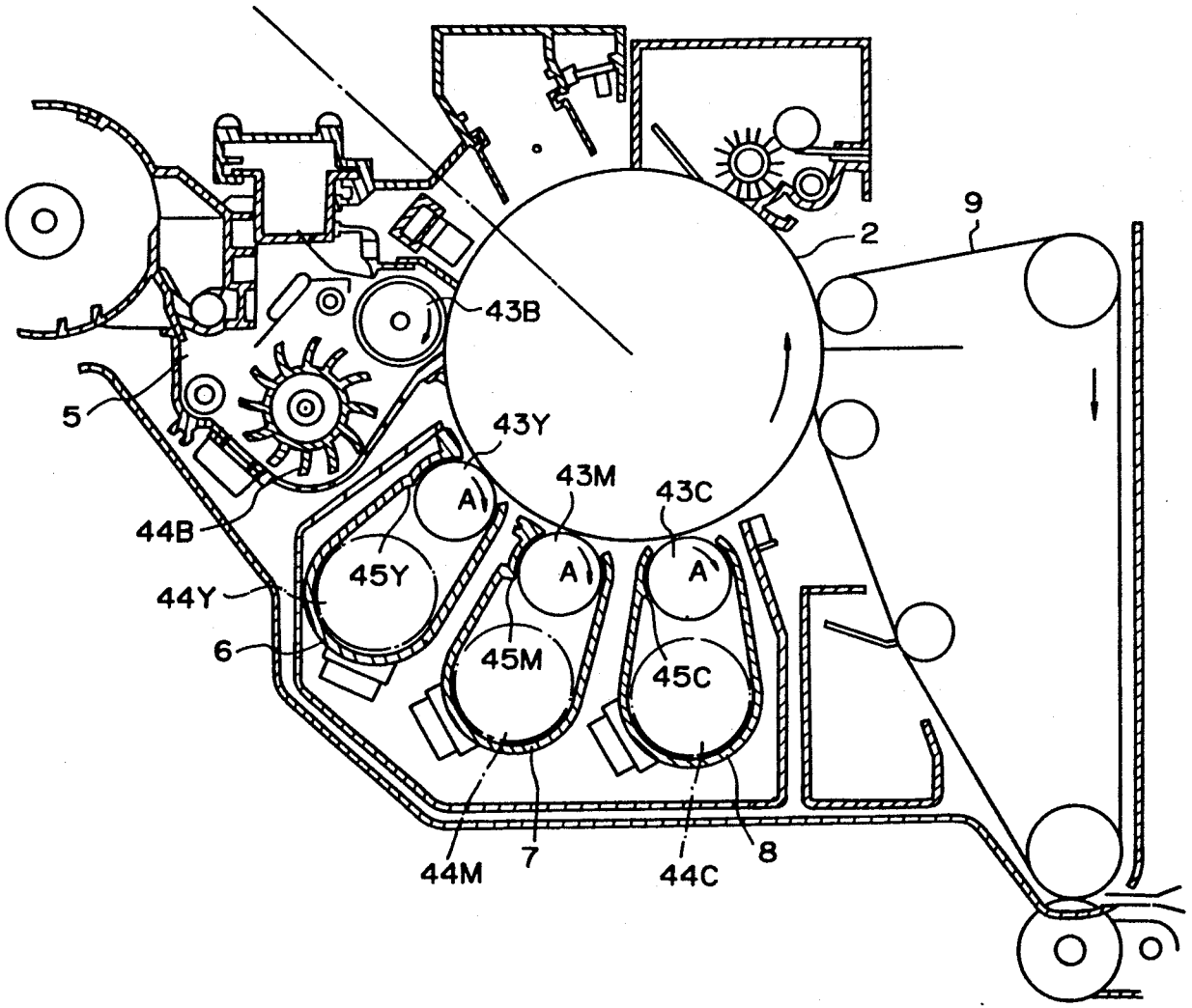
FIG. 5 is a fragmentary enlarged section of the embodiment.

As shown in FIG. 5, the developing units 5–8 include respectively non-magnetic developing sleeves 43B, 43Y, 43M and 43C which serve as developer carriers and are spaced apart from the drum 2 by a gap of, for example, 0.60 millimeter. The developing sleeves 43B–43C each accommodates therein a magnet having a plurality of poles alternating with each other, and a magnetic shield plate made of a magnetic material, although not shown in the figure. In the event of development, the developing sleeves 43B–43C are respectively rotated by a black drive motor, a yellow drive motor, a magenta drive motor and a cyan drive motor, not shown, in a direction indicated by an arrow A. The black developing unit 5 stores a developer which is a mixture of black toner and carrier. In this developing unit 4, a developer agitating, transporting and scooping member 44B is rotated to supply the developer to the developing sleeve 43B. The developer deposited on the developing sleeve 43B is regulated to a predetermined thickness by a regulating member 45B. As the developing sleeve 43B rotates, the developer magnetically retained on the sleeve 43B and forming a magnet brush is conveyed to a developing region where the sleeve 43B faces the drum 2. As a result, the toner develops an electrostatic latent image formed on the drum 2 to convert it to a black toner image.

Likewise, the other developing units 6–8 store respectively a mixture of yellow toner and carrier, a mixture of magenta toner and carrier, and a mixture of cyan toner and carrier and accommodate respectively developer agitating, transporting and scooping members 44Y, 44M and 44C and developing sleeves 43Y, 43M and 43C. The members 44Y, 44M and 44C are each rotated to feed the associated developer to the associated developing sleeves 43Y, 43M or 43C. The developer deposited on any one of the sleeves 43Y–43C is regulated to a predetermined thickness by associated one of regulating members 45Y, 45M and 45C. The developer magnetically retained on the sleeve 43Y, 43M or 43C and forming a magnet brush is transported to a developing region where the sleeve faces the drum 2. As a result, a latent image electrostatically formed on the drum 2 is developed to become a yellow, magenta or cyan toner image.

The carrier for forming a magnet brush may be implemented by any one of conventional insulative carriers and conductive carriers. Typical of conventional carriers are one having a ferrite core having a true specific gravity of 5 to 6 g/cm$^3$ and coated with silicone or insulative resin whose mean particle size is 40 to 60 μm, one having an iron or ferrite core having a true specific gravity of 4 to 6 g/cm$^3$ and coated with silicone, styrene-acryl resin or silicone resin whose mean particle size is 30 to 100 μm, and one forming particles. Also, the toner may be constituted by any one of conventional toners including a toner chargeable to negative polarity and to which hydrophobic silica or titanium oxide is added. In a developing apparatus using such a carrier and a toner, an electrostatic latent image on the drum 2 is developed by reversal development.

Image forming conditions particular to the embodiment are as follows.

The drum 2 is rotated at a peripheral speed of 180 mm/sec while being charged to −600 V by the main charger 3. A laser beam issuing from the laser optics and associated with any one of black, yellow, magenta and cyan image signals illuminates the charged surface of the drum 2 to electrostatically form a latent image thereon. At this instant, a potential of −30 V is deposited on the background of the drum 2. The latent image is developed by one of the developing units 5–8 to become a black, yellow, magenta or cyan toner image. The developing units 5–8 are positioned such that their developing sleeves 43B, 43Y, 43M and 43C are spaced apart by a gap of 0.6 millimeters from the drum 2. During development, a bias voltage for development, e.g., an AC voltage in the form of a rectangular wave whose peak-to-peak voltage is 1.8 V and frequency is 2 kHz and on which a −450 V DC voltage is superposed is applied to the developing sleeve 43B, 43Y, 43M or 43C. The sleeves 43B–43C are each rotated at a peripheral speed about 1.8 times the peripheral speed of the drum 2 and supplied with the associated developer at a rate of about 0.10 g/cm$^2$. The toner image formed on the drum 2 is transferred to the transfer belt 9 by the bias rollers 15 and 16 to which a transfer bias is applied. In a monocolor copy mode, the toner image on the drum 2 is transferred to the belt 9 by the transfer bias rollers 15 and 16 to which a transfer bias is applied. In the monocolor copy mode, the toner image on the transfer belt 9 is transferred to a paper sheet fed from the paper feed unit 17 via the register roller 18 by the transfer bias roller 19. On the other hand, in a color copy mode using two or more colors, toner images of two or more colors are sequentially transferred from the drum 2 to the transfer belt 9 one above another to form a color image. This color image is transferred from the transfer belt 9 to a paper sheet also fed from the paper feed unit 17 via the register roller 18.

Assume that use is made of a carrier of the kind increasing the resistance thereof when the toner adheres fast thereto due to aging, i.e., in a spent condition. In such a case, the illustrative embodiment controls the bias electric field for development in a unique way to prevent the image quality from changing with the elapse of time, as follows.

When the above-mentioned type of carrier is used, edge emphasis is apt to occur due to the increase in the resistance of the carrier and degrades the image quality, as discussed earlier. In the embodiment, a reference latent image, as distinguished from a usual latent image representative of a document, is electrostatically formed on the drum 2 and then developed by predetermined one of the developing units to form a reference toner image. Then, the degree of edge emphasis, i.e., the degree to which the density of the edges of the reference toner image exceeds that of the central portion surrounded by the edges is determined. When the degree of edge emphasis exceeds an allowable range, the peak-to-peak voltage of the AC component of the bias voltage for development is increased to reduce or eliminate edge emphasis. It is to be noted that to measure the degree of edge emphasis means is to measure the degree of deterioration of the developer as well.

Figure 6A:
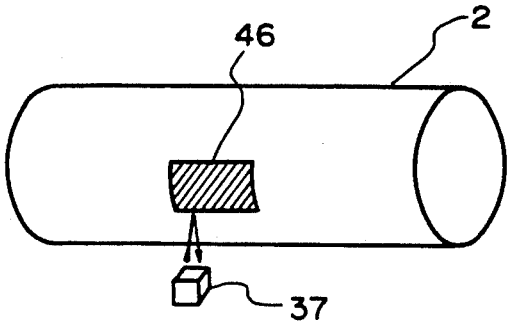
FIG. 6A is a fragmentary perspective view of the embodiment.
Figure 6B:
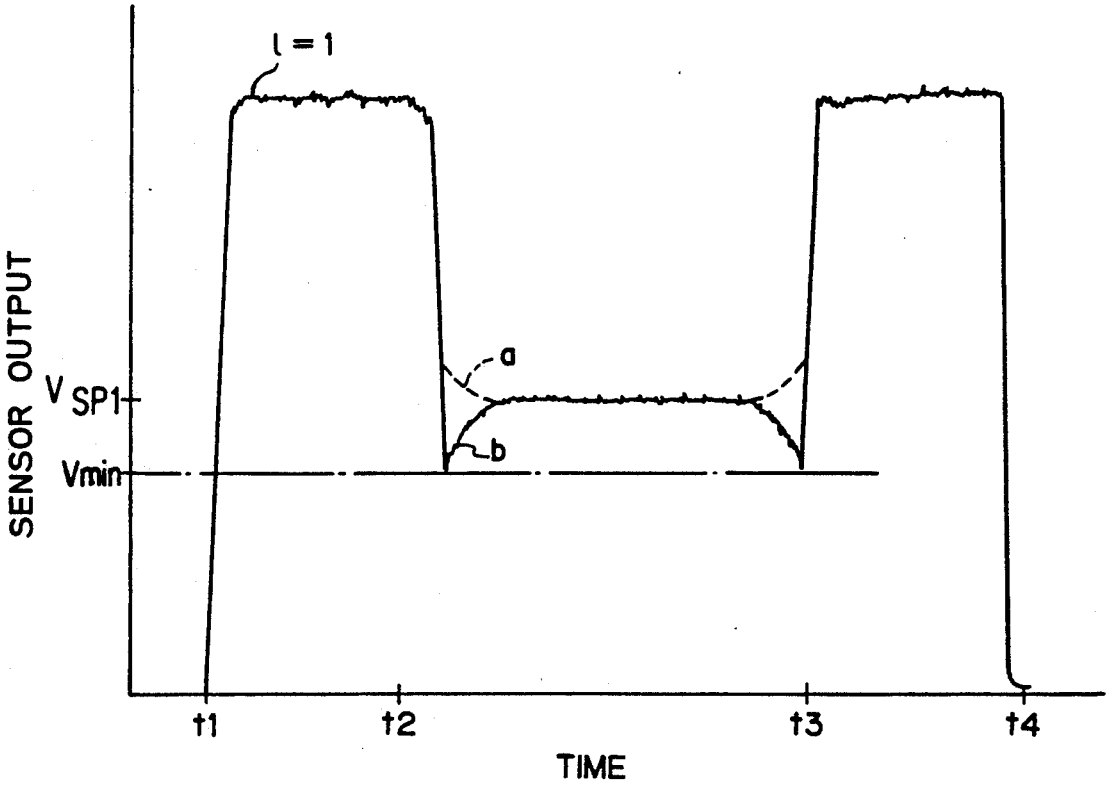
FIG. 6B shows specific waveforms representative of the outputs of an optical sensor included in the embodiment.
Figure 6C:
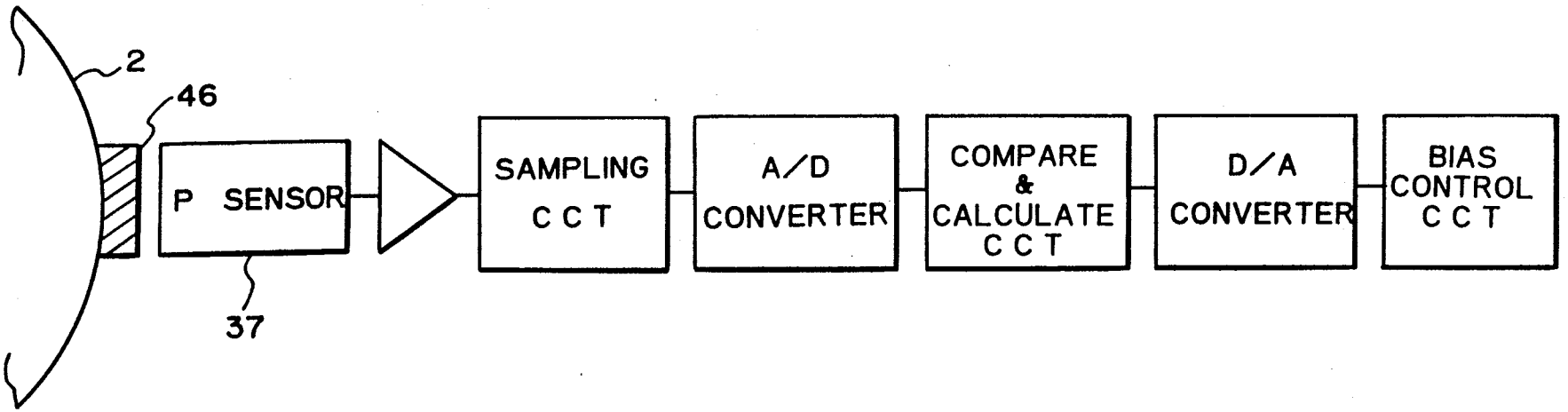
FIG. 6C is block diagram schematically showing a control arrangement associated with the output of the optical sensor and the control over the bias voltage.

How the degree of edge emphasis is determined will be described first. As shown in FIG. 6A, a latent image representative of a reference pattern having a reference density is developed by one of the developing units 5–8 to form a reference toner image 46 on the drum 2. The optical sensor 37 facing the surface of the drum 2 senses the reference toner image 46. FIG. 6C is a block diagram schematically showing an arrangement for the detection of the reference toner image 46 by the sensor 37 and the control over the bias voltage for development which will be described. FIG. 6B shows a specific output of the sensor 36 appearing when the sensor 36 senses the density of the reference toner image 46. In FIG. 6B, part of the signal starting at a time t2 and ending at a time t3 is representative of the reference toner image 46 sensed by the sensor 37. The signal appearing from the time t3 to a time t4 corresponds to the background of the drum 2. Dots shown in FIG. 6B indicate the points at which the output of the sensor 37 is sampled. A dotted curve a and a solid curve b indicate respectively a specific sensor output appearing when the developer is not deteriorated and a sensor output appearing when the carrier of the developer is deteriorated due to the adhesion of the toner (spent condition). Regarding the solid curve b, edge emphasis occurs due to the increase in the resistance of the carrier included in the developer, i.e., the minimum value Vmin appears at opposite edge portions of the reference toner image 46. In the central portion of the reference toner image, the solid line b, like the dotted line a, remains substantially flat without changing with the elapse of time. Therefore, the embodiment uses the minimum value Vmin of the sensor output as a value representative of the edges of the reference toner image 46 and uses the mean (running average) of values measured at the multiple sampling points in the range wherein the sensor output remains substantially stable as a value Vsp representative of the central portion. The difference between the value Vsp and the minimum value Vmin is representative of the degree of edge emphasis.

Figure 7:
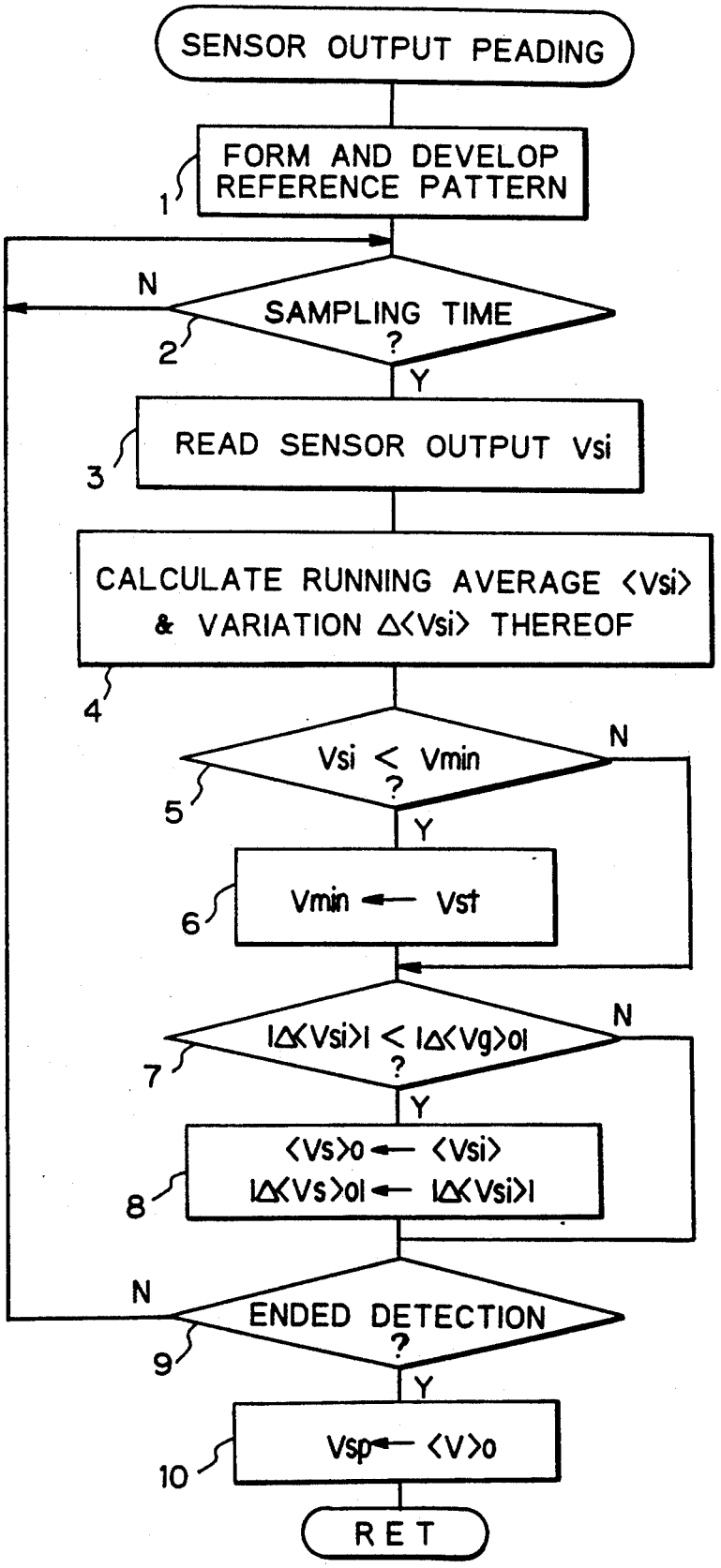
FIG. 7 is a flowchart demonstrating part of processing to be executed by a main controller included in the embodiment.

A reference will be made to FIG. 7 for describing a specific procedure for detecting the sensor outputs Vmin and Vsp representative of, respectively, the edge and the central portion of the reference toner image 46. As shown, the main controller or CPU 31 forms a reference pattern on the drum 2 repetitively at predetermined intervals while causing any one of the developing units 5–8 to develop it (step 1). For example, the image processor sends an image signal representative of the reference pattern to the laser optics 4 to electrostatically form a reference pattern latent image on the drum 2, and one of the developing devices 5–8 develops the latent image. Subsequently, the CU 31 senses the density of the reference toner image 46 by the optical sensor 37 (steps 2 and 3). For example, at the time t2, the CPU 31 starts reading the output of the sensor 37 via the I/O interface 34 at predetermined sampling intervals. Assume that the signal voltage at the i-th point of measurement by the sensor 37 is Vsi (i being a positive integer). Every time the CPU 31 reads one Vsi from the sensor 37, it calculates a running average $<Vsi>$ of several voltages preceding the one voltage Vsi and several voltages following the same, and a variation $\Delta<Vsi>$ representative of a difference between the determined running average and the previous running average (step 4). The CPU 31 compares the current Vsi with the minimum value Vmin of the previously sampled Vsi's and, if the former is smaller than the latter, writes Vsi in the RAM 33 as a new minimum value Vmin (steps 5 and 6). Thereafter, the CPU 31 compares the absolute value of the variation of the current running average $|\Delta<Vsi>|$ with the absolute value of the previous running average $|\Delta<Vs>_o|$ and, if the former is smaller than the latter, writes the current running average $<Vsi>$ in the RAM 33 as a new running average $<Vs>_o$ associated with the minimum absolute value of the variation of running average. At the same time, the CPU 31 stores the absolute value of the variation of the current running average $|\Delta<Vsi>|$ in the RAM 33 as a new minimum value $|\Delta<Vs>_o|$ of the absolute value of the variation of running average (steps 7 and 8).

The CPU 31 repeats the sequence of steps 2–8, i.e., returns to the step 2 when the answer of a step 9 is negative, N. On completing the detection, the CPU 31 writes the running average $<Vs>_o$ existing in the RAM 33 in the RAM 33 as a measured value Vsp representative of the central portion of the reference toner image 46 (step 10). It is to be noted that the minimum value Vmin (step 6) existing in the RAM 33 at the end of detection is the measured value Vsi corresponding to the minimum value of the sensor output.

Figure 8:
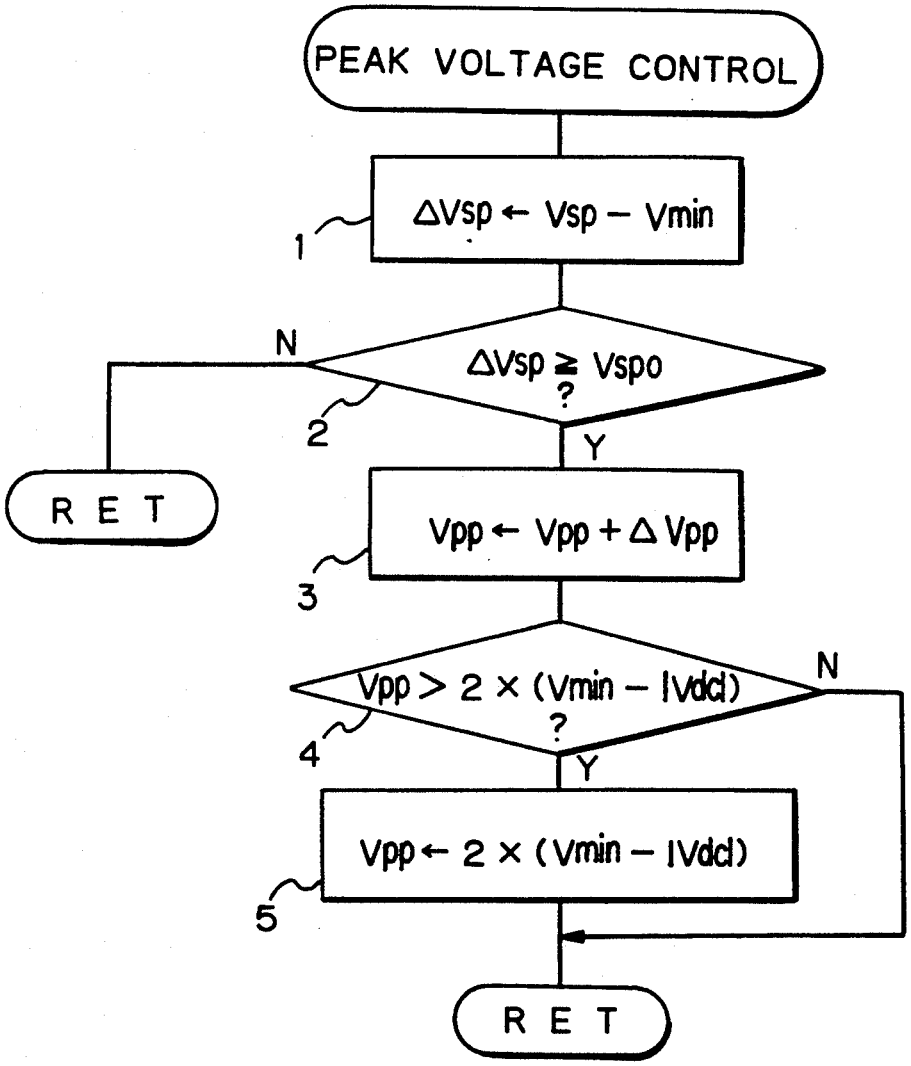
FIG. 8 is a flowchart demonstrating another part of the processing of the main controller.

FIG. 8 shows a specific routine in which the CPU 31 determines the degree of edge emphasis on the basis of the values Vmin and Vsp associated with the reference toner image 46 and controls the peak-to-peak voltage Vpp of the AC component of the bias voltage in matching relation to the determined degree of edge emphasis. As shown, the CPU 31 calculates a difference ΔVsp between Vsp and Vmin and determines whether or not the difference is greater than or equal to a reference value Δspo, i.e., whether or not the degree of edge emphasis lies in an allowable range (steps 1 and 2). If the difference Δsp is equal to or greater than the reference value Δspo, the CPU 31 increases the peak-to-peak voltage Vpp of the developing device having just developed the reference pattern latent image by a predetermined value ΔVpp (step 3). While the value Δpp may be proportional to ΔVsp, the embodiment uses ΔVpp=100 V. Should Vpp exceed a certain value, discharge would occur in the gap between the developing sleeve and the drum 2. Also, should Vpp be set at an excessively high level, the amount of toner deposition would be reduced in black portions (where the difference in potential between the developing sleeve and the latent image is great), preventing tonality from being rendered. Preferably, therefore, an upper limit should be assigned to each of ΔVpp and Vpp. In the illustrative embodiment, Vpp is selected such that either of the absolute value of the positive component and that of the negative component of the bias voltage which is greater than the other does not exceed an upper limit Vmax. For example, the upper limit Vmax is selected to be 2,000 V although it depends on the frequency of the AC component of the bias voltage and the image forming conditions. When the bias voltage is implemented as a DC component Vdc on which the oscillation component (peak voltage Vpp>0) of a rectangular wave having a duty ratio of 1:1 is superposed, Vpp is selected as follows (steps 4 and 5):

$$Vpp \leqq 2 \times (Vmax - |Vdc|)$$

Figure 9:
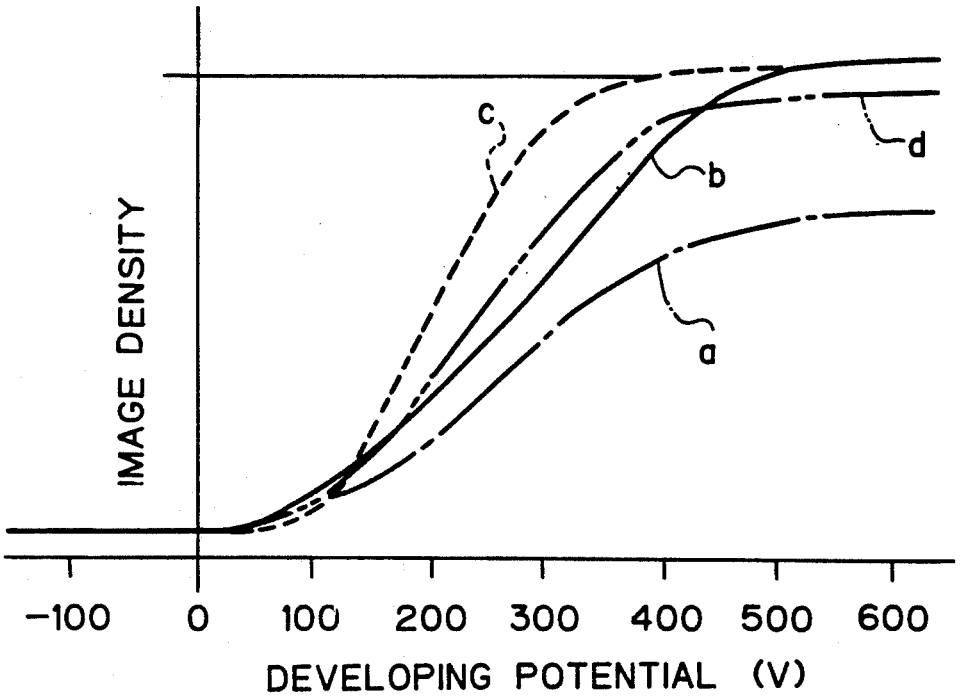
FIG. 9 is shows a relation between the developing potential and the image density.

When the peak-to-peak voltage Vpp is changed to prevent the image quality from being lowered by edge emphasis, the tonality of an image or the amount of toner to deposit on the drum 2 (developing density) relative to the electric field in the developing region changes. FIG. 9 shows a relation between the developing potential, i.e., the difference between the potential of the drum 2 and that of the developing sleeve (potential set up by a DC component when the bias voltage has the DC component and an AC component) and the image density. In FIG. 9, curves a, b, c and d were obtained under the following conditions:

a: Bias voltage is implemented by a DC voltage, and the ratio of linear velocity Vs of drum to linear velocity Vp of developing sleeve is 1.8;

b: Bias voltage is implemented by a DC voltage, and the ratio Vs/Vp is 3.0;

c: Bias voltage has a DC component and an AC component, the peak-to-peak voltage is 1.8 kV, and the ratio Vs/Vp is 1.8;

d: Bias voltage has a DC component and an AC component, the peak-to-peak voltage is 0.5 kV, and the ratio Vs/Vp is 1.8.

By comparing the curves c and d, it will be seen that the tonality and developing density can be changed if the toner concentration of the developer in the developing unit, the charge potential of the drum 2, the quantity of light to be incident on the drum 2 (quantity of light issuing from a laser or a lamp) and the like are changed, as well known in the art. The curves a and b indicate that a change in the linear velocity ratio between the drum 2 and the developing sleeve results in a change in the tonality and developing density. Further, the curves a and c show that whether the bias voltage is a DC voltage or a combination of DC and AC voltages has influence on the tonality and developing density. Therefore, when the peak-to-peak voltage is changed to prevent the image quality from being lowered by edge emphasis, it is necessary to prevent the tonality of an image or the amount of toner to deposit on the drum 2 relative to the electric field in the developing region from being changed. For this purpose, it is preferable to change the reference value assigned to each of the toner concentration sensors 38B–38C of the developing units 5–8, to change the grid potential of the main charger 3, i.e., the potential of the drum 2, to change the linear velocity ratio Vs/Vp, to change the potential of the developing sleeve, and to change the amount of exposing light, as well as other conditions included in the electrophotographic process, as needed. At this instant, the frequency of the AC component of the bias voltage may be changed to change tonality, as has been customary.

Figure 10A:
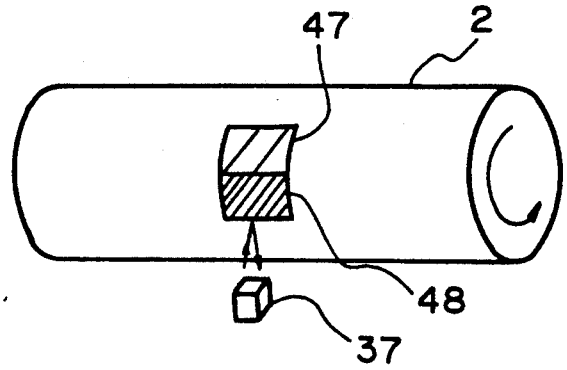
FIG. 10A is a fragmentary perspective view showing an alternative embodiment of the present invention.
Figure 10B:
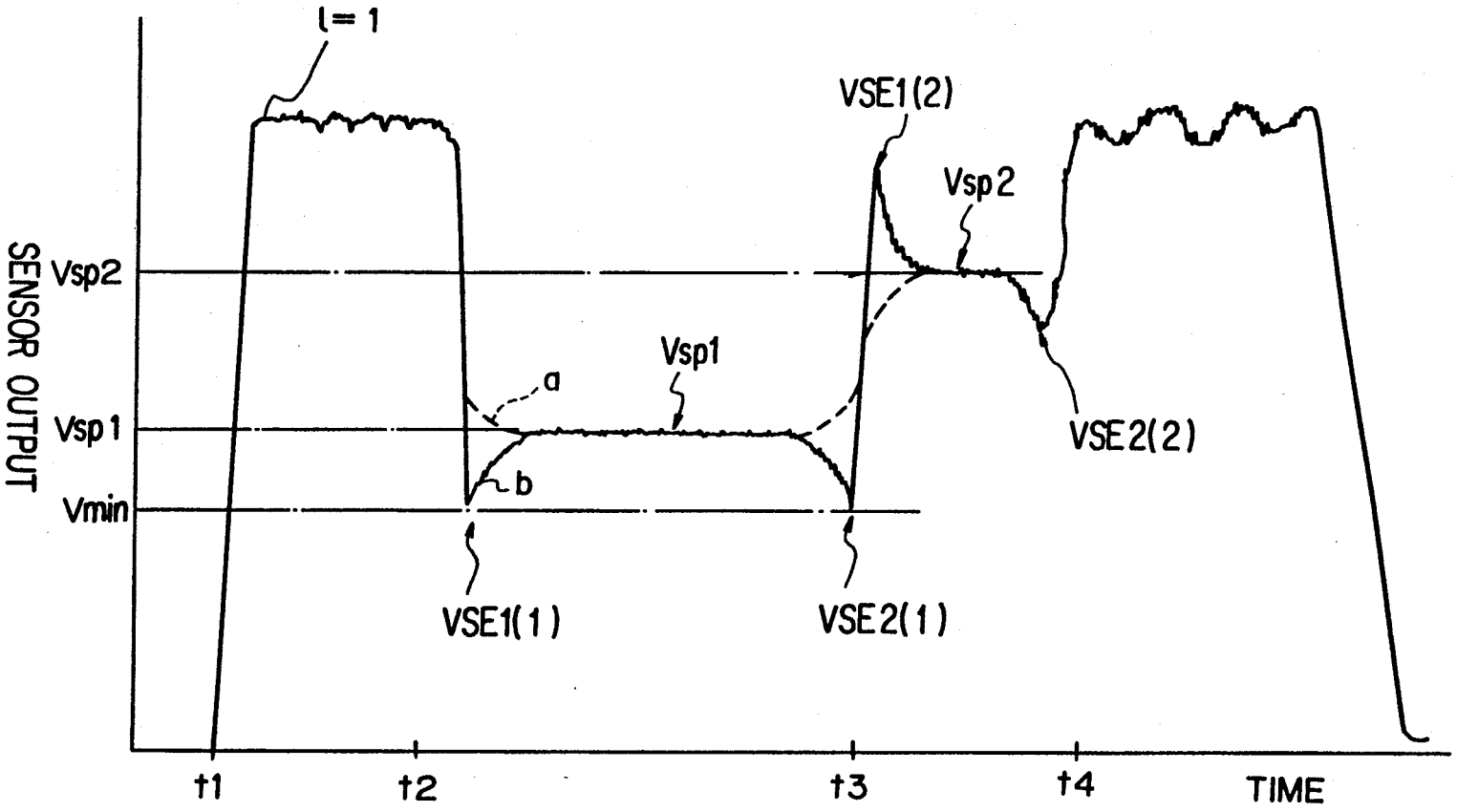
FIG. 10B shows specific waveforms of the outputs of an optical sensor included in the embodiment of FIG. 10A.

FIG. 10A shows two contiguous patterns 47 and 48 each having a particular reference density and which may be used in placed of the toner image 46 having a single reference density. Then, as shown in FIG. 10B, the output of the optical sensor 37 includes a portion extending between the time t2 and a time t4 and representative of the two patterns 47 and 48. In FIG. 10B, a dotted curve a and a solid curve b indicate respectively specific sensor outputs associated with a fresh developer and a spent carrier. By using such a sensor output, the CPU 31 can determine a difference between the edges and the central area with each of the two patterns 47 and 48, i.e., differences ΔVsp1 and ΔVsp2. The CPU 31 may control the bias electric field for development on determining that the degree of edge emphasis of at least one of the patterns 47 and 48 has exceeded the allowable range. In FIG. 10B, a maximum value VSE (2) appears in the solid line b in the vicinity of upstream one of opposite edges of the pattern 47 with respect to the direction of rotation of the drum 2. This shows that the amount of toner deposition on the drum 2 is small at and around the upstream edge of the pattern 47 due to the increase in the resistance of the carrier. Therefore, the degree of edge emphasis may also be determined in terms of the degree of decrease in the density of such an edge portion of the pattern 47 relative to the density of the central portion.

Referring to FIGS. 11–14, a specific procedure for determining the measured value associated with the above-mentioned upstream edge of the pattern 47 will be described. As shown in FIG. 10B, assume that the sensor 37 produces an output VSE1 (1) at the upstream edge of the pattern 48 with respect to the direction of rotation of the drum 2, an output VSE2 (1) at the downstream edge of the pattern 48, an output Vsp (1) at the central portion of the pattern 48, an output VSE1 (2) at the upstream edge of the pattern 47, an output VSE2 (2) at the downstream edge of the pattern 47, and an output Vsp (2) at the central portion of the pattern Vsp (2).

Figure 11:
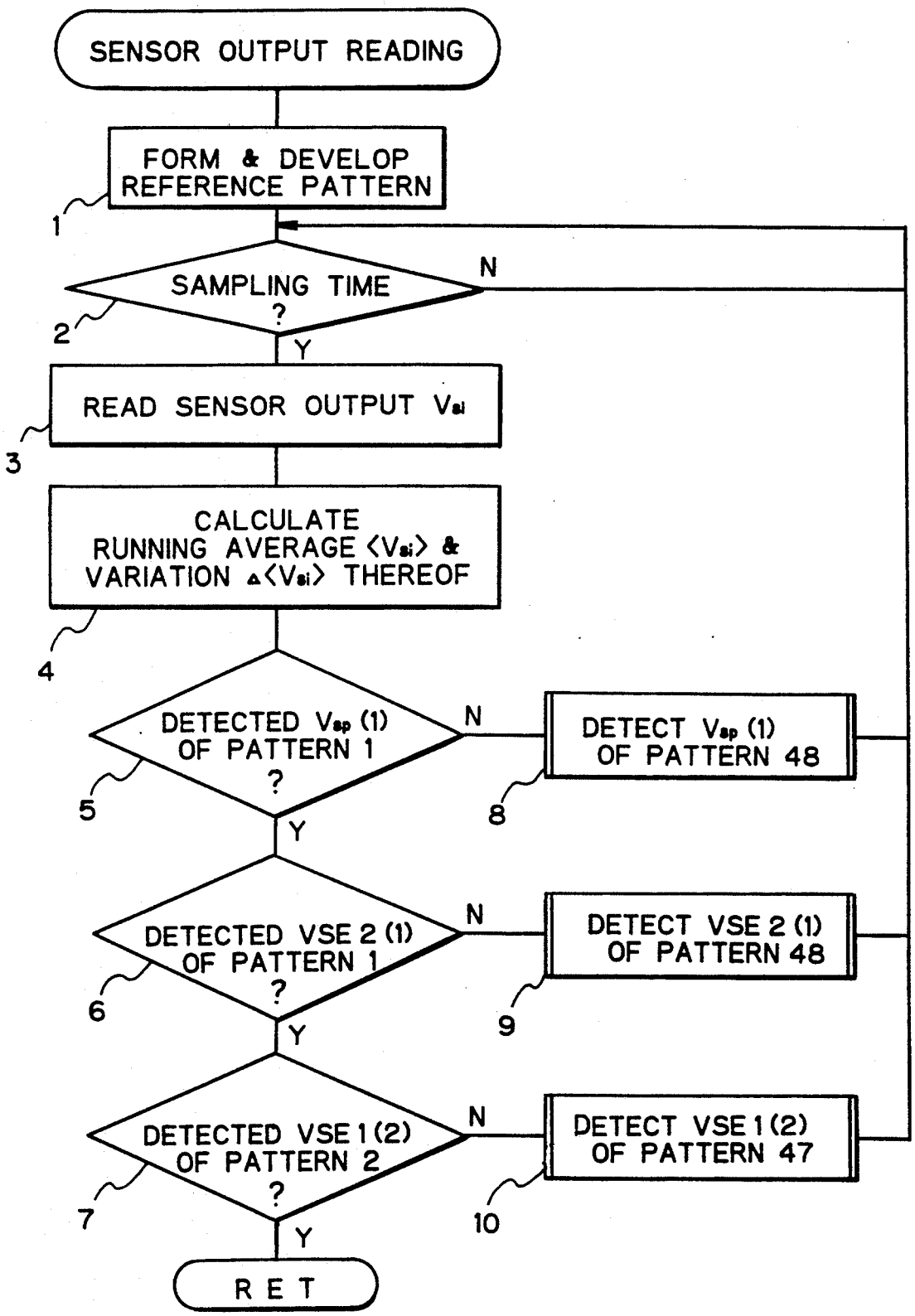
FIG. 11 is a flowchart demonstrating processing to be executed by a main controller included in the embodiment of FIG. 10A.

As shown in FIG. 11, after the patterns 48 and 47 have been formed (step 1), their densities are sensed by the sensor 37 (steps 2 and 3), and then the running average <Vsi> and the variation Δ<Vsi> of the running average are calculated (step 4), as in the previous embodiment. In steps 5-10, Vsp (1) and VSE2 (1) of the upstream pattern 48 and VSE1 (2) and Vsp (2) of the downstream pattern 47 are detected. Specifically, Vsp (1), VSE2 (1) VSE1 (2) and Vsp (2) are detected in the steps 8 (subroutine shown in FIG. 12), 9 (subroutine shown in FIG. 13), and step 10 (subroutine shown in FIG. 14), respectively. The steps 5, 6 and 7 are decision steps for determining whether or not the respective values have been detected and are executed by use of respective flags which will be described with reference to FIGS. 12, 13 and 14.

Figure 12:
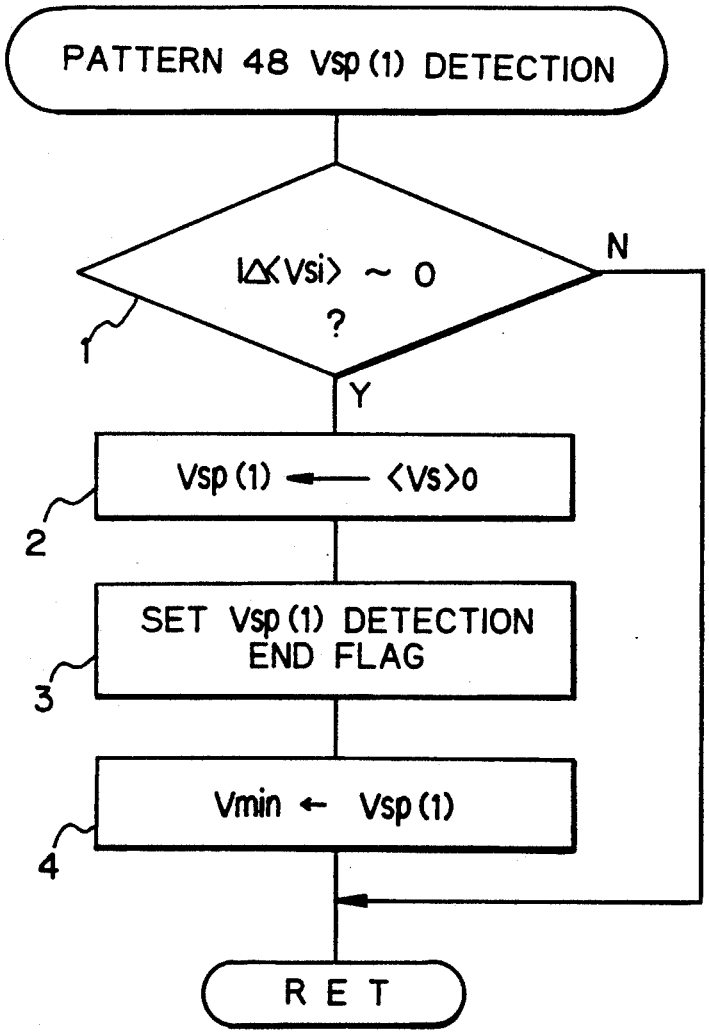
FIGS. 12–14 are flowcharts each being representative of a particular subroutine included in the processing of FIG. 11.

FIG. 12 shows a specific subroutine relating to the sensor output Vsp (1). As shown, when the absolute value of the variation of running average reaches substantially zero (Y, step 1), the CPU 31 writes the existing running average $<Vs>_0$ associated with the minimum absolute value of the variation in the RAM 33 as Vsp (1) (step 2), resets a Vsp (1) detection end flag (step 3), and writes the value of Vsp (1) in the RAM 33 as a minimum value Vmin.

Figure 13:
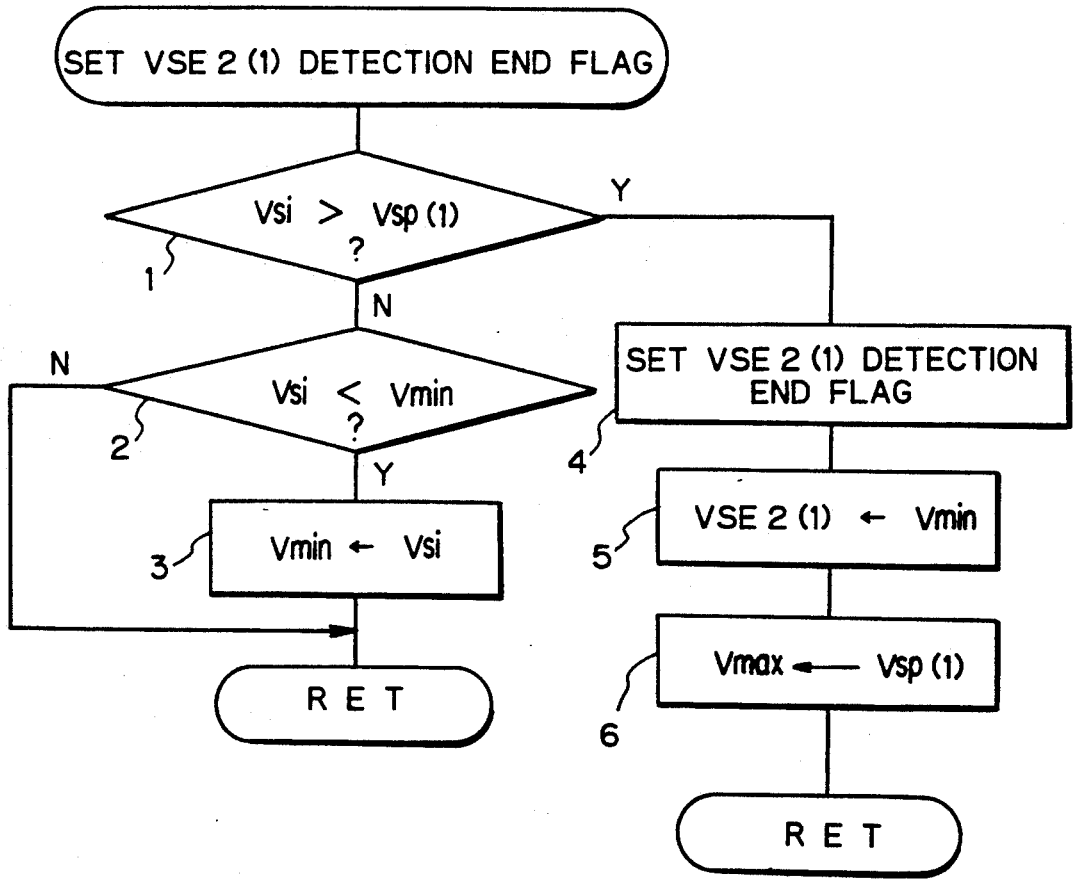

FIG. 13 shows a specific subroutine relating to the sensor output VSE2 (1). As shown, while Vsi remains smaller than the sensed Vsp (1) (N, step 1), the CPU 31 compares Vsi with the minimum value Vmin having appeared after Vsp (1) and, if the former is smaller than the latter, writes Vsi in the RAM 33 as a new minimum value Vmin (steps 2 and 3). When Vsi exceeds the sensed Vsp (1) (Y, step 1), the CPU 31 sets a VSE2 (1) detection end flag (step 4), stores the minimum value Vmin in the RAM 33 as VSE2 (1) (step 5), and stores the value of Vsp (1) in the RAM 33 as a maximum value Vmax (step 6).

Figure 14:
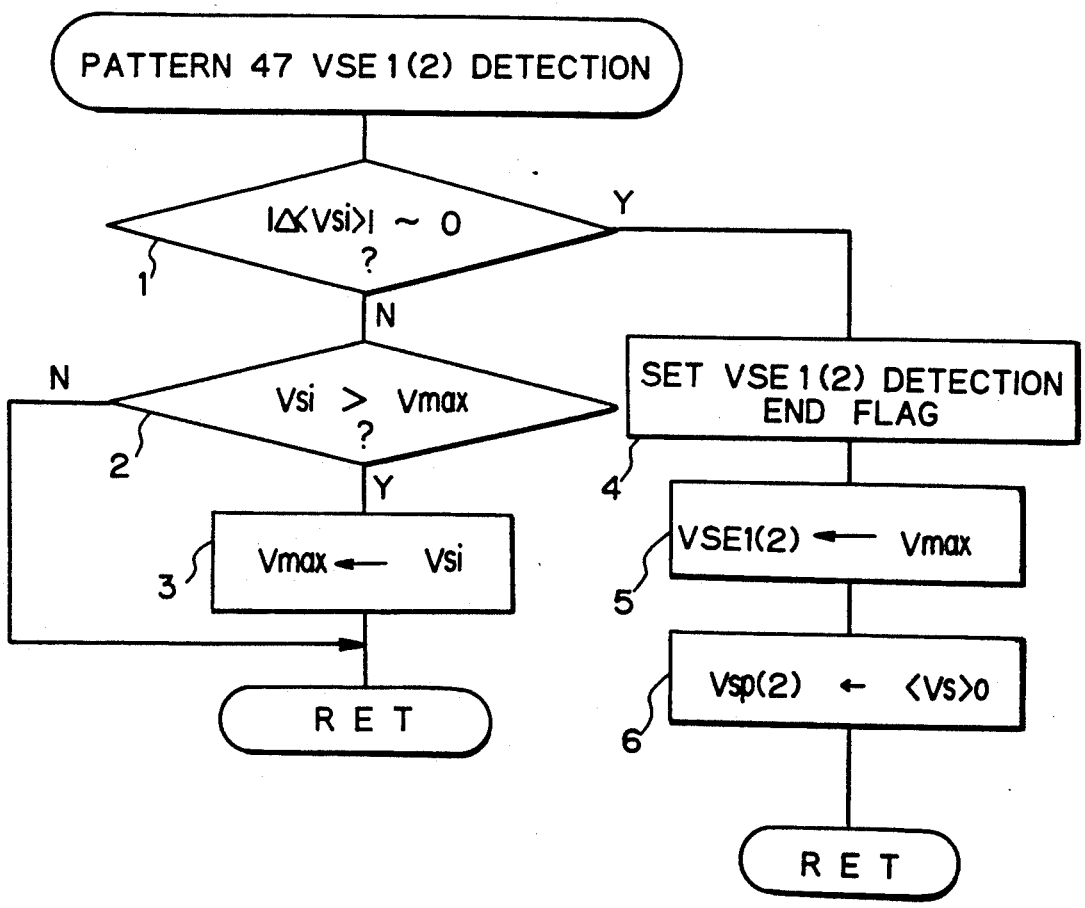

Regarding VSE1 (2) and Vsp (2), as shown in FIG. 14 specifically, the CPU 31 compares Vsi with the above-mentioned maximum value Vmax and, if the former is greater than the latter, writes it in the RAM 33 as a new maximum value Vmax (steps 2 and 3), until the absolute value of the variation of running average substantially reaches zero (N, step 1). As the absolute value of the variation becomes substantially zero (Y, step 1), the CPU 31 sets a VSE1 (2) detection end flag (step 4), writes the maximum value Vmax in the RAM 33 as VSE1 (2) (step 5), and writes the existing running average $<Vs>_0$ in the RAM 33 as Vsp (2) (step 6).

Figure 15:
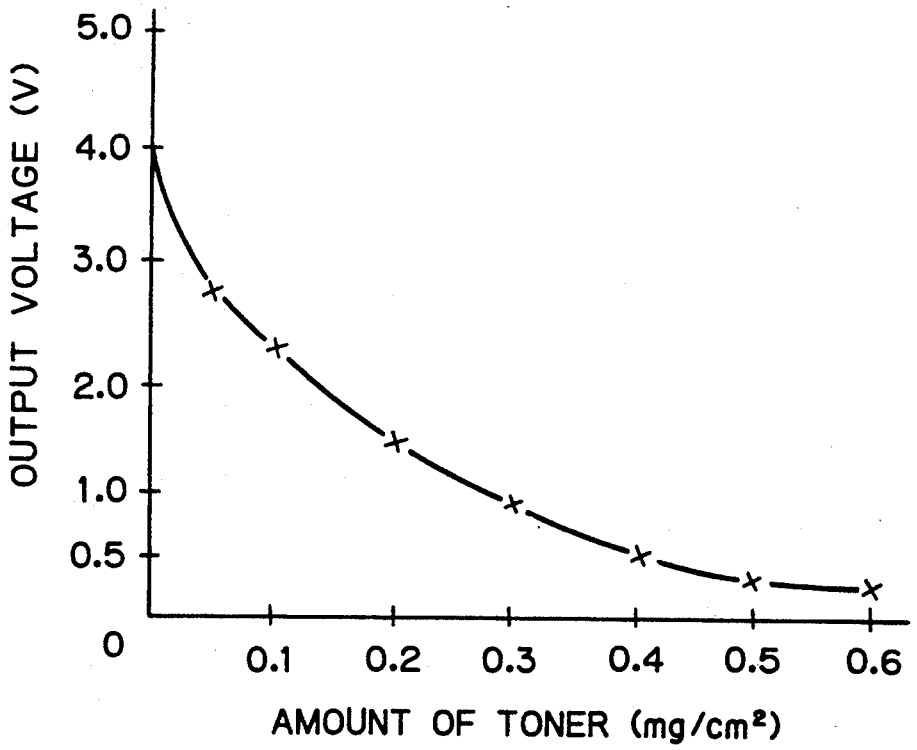
FIG. 15 shows the output characteristic of the optical sensor.

By using the values Vsp (1) and VSE2 (1) associated with the upstream pattern 48 and the values VSE1 (2) and Vsp (2) associated with the downstream pattern 47, the CPU 31 may control the bias electric field on determining that the degree of edge emphasis of at least one of the two patterns has exceeded the allowable range. The procedure described above detects the degree of edge emphasis by using a sensor output associated with upstream one of opposite edges of the downstream pattern 47 where the amount of toner deposition decreases. This kind of procedure is more accurate than the procedure which uses only the edges where the amount of toner deposition decreases compared to the central portion. This is because the sensor 37 shows faster response in an area where the amount of toner deposition is small than in an area where it is great, as shown in FIG. 15.

Figure 16:
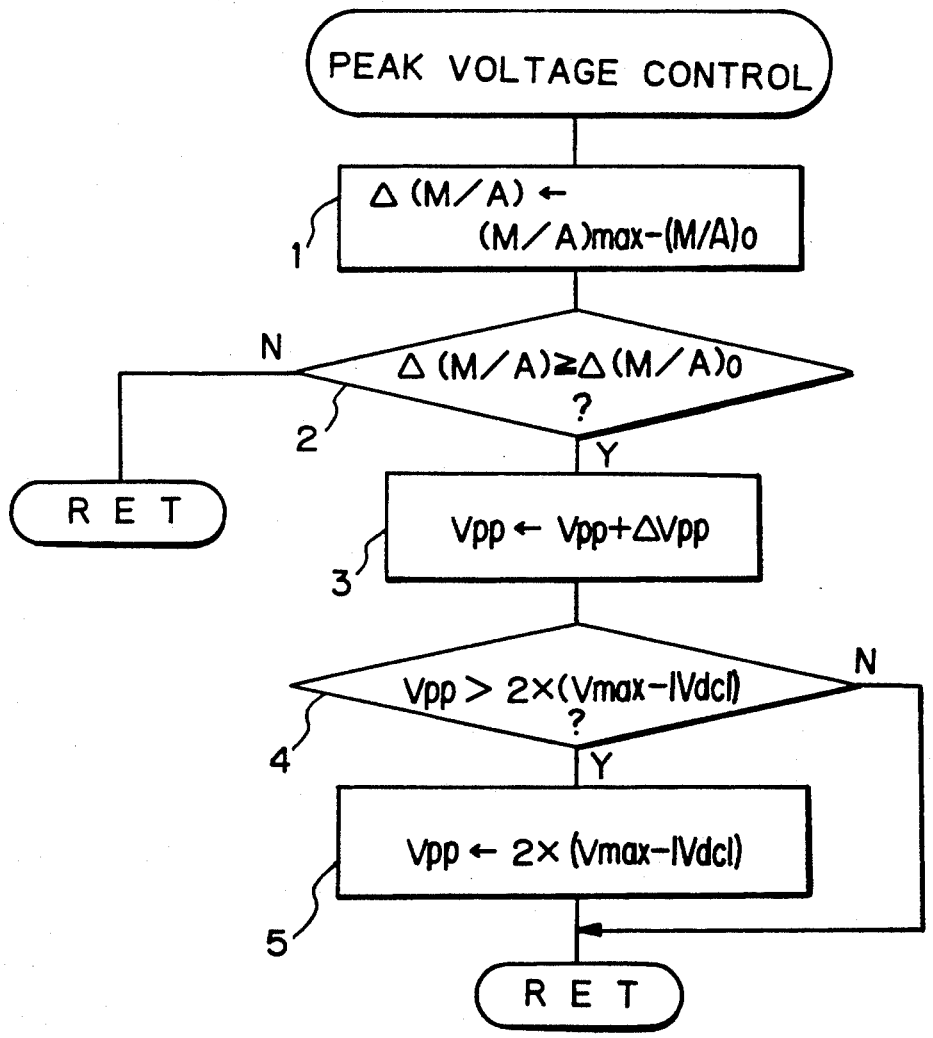
FIGS. 16–19 are flowcharts each being representative of another alternative embodiment of the present invention.

If desired, only VSE (2) and Vsp (2) of the downstream pattern 47 may be used in determining the degree of edge emphasis, i.e., Vsp (1) and VSE2 (1) of the upstream pattern 48 may not be sensed. The embodiment has been described as directly using the output of the optical sensor 37 in controlling the bias electric field. Alternatively, to determine the degree of edge emphasis, an amount of toner deposition on the drum 2 may be calculated by, for example, the logarithmic conversion of the output of the sensor 37, as taught in Japanese Patent Laid-Open Publication No. 306874b/1989. This will further enhance accurate detection of the degree of edge emphasis. For the logarithmic conversion, the following equation may be used:

$$(M/A) = -ln\ [(Vsp/Vsg)/\beta]$$

where (M/A) is the mass of deposited toner per unit area, Vsp is a measured value of a toner image, Vsg is a measured value of the background of the drum 2, and $\beta$ is a constant (e.g. $-3.0$ ($cm^2/mg$)). FIG. 16 shows a specific procedure for controlling the bias by using the amount of toner deposition (M/A) produced by the above equation, in the same manner as shown in FIG. 8. In FIG. 16, (M/A)max, (M/A)p and $\Delta(M/A)_0$ denote respectively the amount of toner deposited on the edge of the toner image 46, the amount of toner deposited on the central portion of the toner image 46, and a reference value for determining whether or not the degree of edge emphasis lies in the allowable range.

Figure 17:
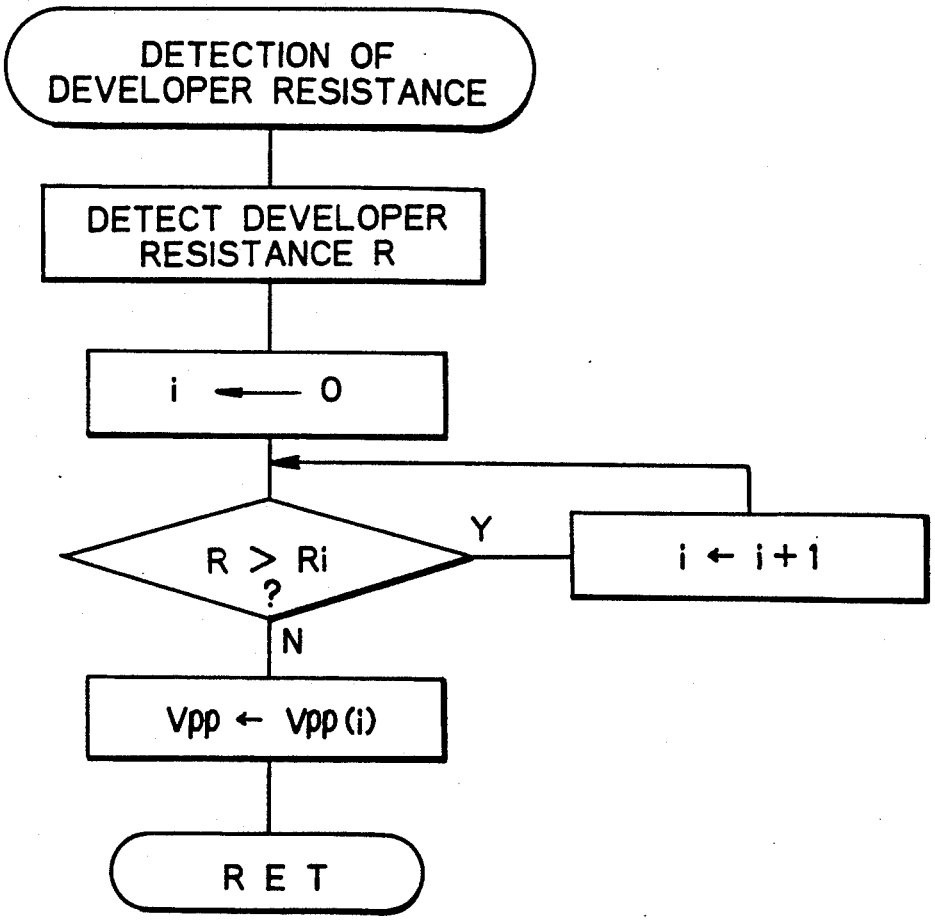

While the embodiment changes the peak-to-peak voltage of the AC component of the bias voltage for suppressing edge emphasis, it may change the frequency of the AC component in place of or in addition to the peak-to-peak voltage. Specifically, when the degree of edge emphasis is increased due to the deterioration of the developer, the frequency of the AC component may be increased. When the AC component has a duty ratio, the duty ratio may be controlled toward 1:1 when the degree of edge emphasis is increased. Furthermore, a mechanism for changing the distance between the drum 2 and each developing sleeve may be incorporated in the apparatus, in which case the distance will be reduced as the degree of edge emphasis increases. The embodiment forms the toner image 46 on the drum 2 and determines the degree of deterioration of the developer in terms of the degree of edge emphasis of the image 46. Alternatively, a resistance sensor may be located in each developing unit to sense the resistance of the developer existing therein, i.e., the degree of deterioration of the developer. In such a case, as shown in FIG. 17 specifically, the CPU 31 may set a peak-to-peak voltage Vpp of the bias electric field matching the resistance of the developer by reading the output of the resistance sensor via the I/O interface 34.

Although the embodiment has been shown and described in relation to a carrier of the kind tending to increase the resistance thereof in a spent state, it is effectively practicable even with a carrier whose resistance increases due to a factor other than the spent state, e.g., temperature and/or humidity. When use is made of a carrier which, contrary to the carrier of the embodiment, tends to decrease the resistance due to the shave-off of the film or the changes in temperature and/or humidity, it is likely that the sharpness is degraded at edges when the resistance decreases. In such a case, a reference toner image may be formed in the same manner as in the above embodiment to determine the degree of fall of sharpness, and the bias electric field may be controlled when the determined degree exceeds an allowable range. The degree of fall of sharpness can be determined by measuring the densities of the edges and central portion of the reference toner image and calculating, for example, a difference between the measured densities, as in the embodiment. The extra toner image for measurement may be replaced with a resistance sensor incorporated in each developing device. Then, the bias electric field will be controlled in matching relation to the resistance of the developer existing in each developing device. Regarding the control of bias electric field, the peak-to-peak voltage and/or the frequency of the AC component should be reduced in order to suppress or eliminate the fall of sharpness, contrary to the embodiment. When the AC component has a duty ratio, the duty ratio may be controlled away from 1:1 on the increase in the degree of fall of sharpness. Again, a mechanism for changing the distance between the drum 2 and the developing sleeve may be incorporated in the apparatus and operated to increase the distance when the degree of fall of sharpness increases. The control of the bias electric field based on the degree of edge emphasis or the degree of fall of sharpness described above may be effected at any suitable timing, e.g., every time a predetermined number of copies are produced, immediately after the turn-on of a power switch provided on the apparatus, or at the time of initial adjustment by a serviceman at the user's location. For the formation of the reference toner image, use may be made of a bias electric field adapted to form images representative of documents or an exclusive bias electric field for the reference toner image.

Figure 18:
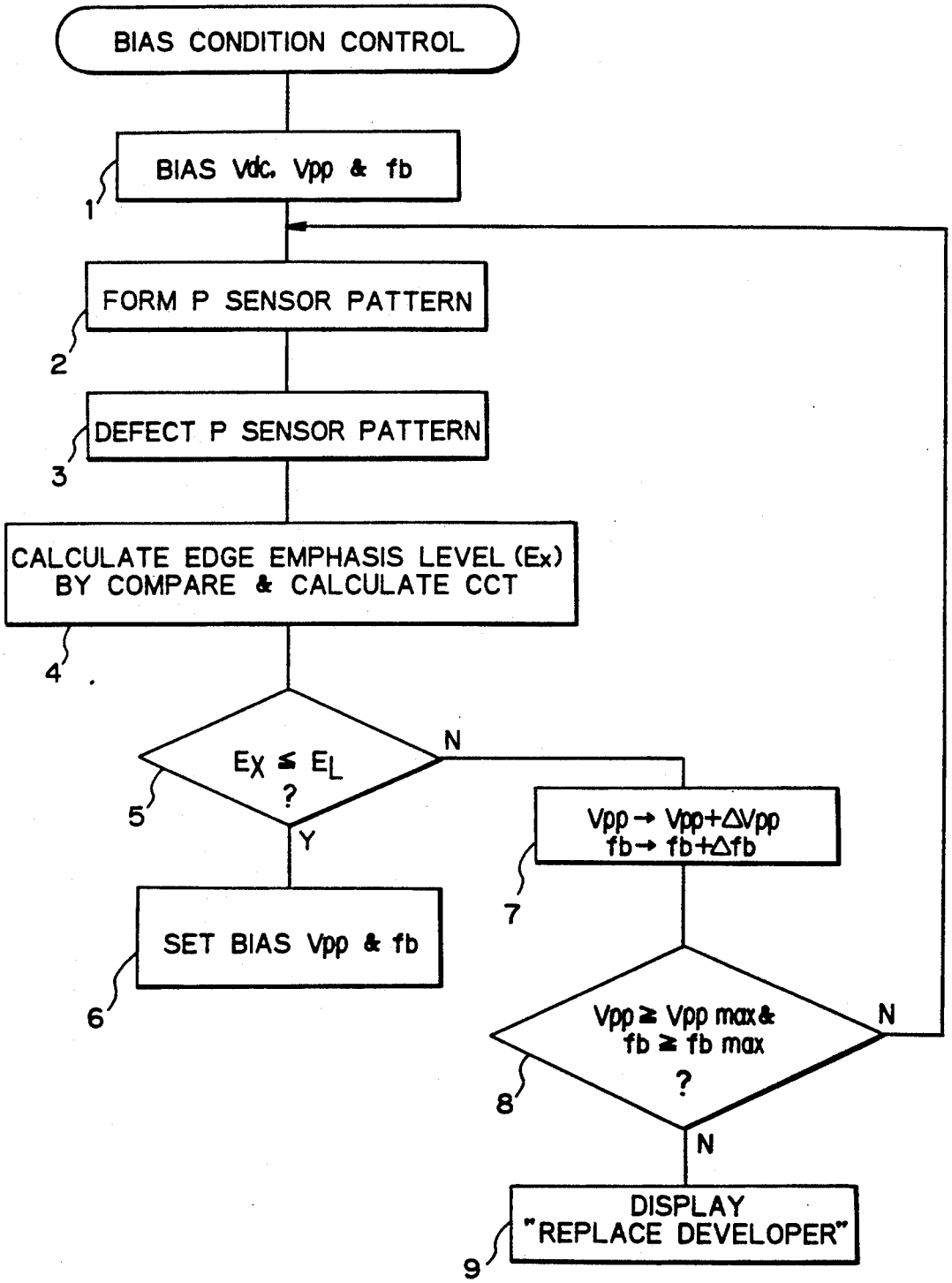

FIG. 18 shows a specific procedure for forming a reference toner image for measurement by using an exclusive bias electric field as mentioned above. As shown, the CPU 31 sets a particular value Vdc of the DC component of the bias voltage and a particular peak-to-peak voltage Vpp and a frequency fb of the AC component to thereby set an initial bias voltage (step 1). Then, as in the embodiment, the CPU 31 forms a reference toner image (FORM P SENSOR PATTERN) (step 2) and senses the density of the reference toner image by the sensor 37 (SENSE P SENSOR PATTERN) (step 3). The CPU 31 calculates a degree of edge emphasis Ex (e.g. difference between the density of the central portion and the edges of the toner image) (step 4) by using the resulting output of the sensor 37 and compares the calculated degree with a reference value E (step 5). If the calculated degree lies in the allowable range (Y, step 5), the CPU 31 sets the conditions of the initial bias voltage as bias conditions for forming images representative of documents. If the calculated degree does not lie in the allowable range (N, step 5), the CPU 31 increases the peak-to-peak voltage Vpp and frequency fb of the bias voltage for a reference toner image by a predetermined amounts ($\Delta$Vpp and $\Delta$fb) and then determines whether or not the resulting Vpp and fb exceed upper limits Vppmax and $\Delta$fbmax, respectively (steps 7 and 8). The CPU 31 repetitively forms a reference toner image and determines the density thereof (steps 2, 3, 4, 5, 7 and 8) until it determines that the degree of edge emphasis of the reference toner image falls in the allowable range (Y, step 5) or that changed values Vpp and fb exceed their upper limits Vppmax and $\Delta$fbmax (step 8). On determining that the degree of edge emphasis of the reference toner image formed by the changed peak-to-peak voltage Vpp and frequency fb lies in the allowable range, the CPU 31 sets the changed conditions as bias conditions for forming images representative of documents (step 6). Conversely, when the changed values Vpp and fb exceed their upper limits Vppmax and $\Delta$fbmax (Y, step 8), the CPU 31 drives predetermined display means for urging the operator to replace the developer (step 9).

The above-described control may be effected just after the turn-on of the power switch in response to a signal representative of opening/closing of the switch. Alternatively, to effect such control at the time of initial adjustment at the user's location, the control may be started in response to a particular code entered on, for example, numeral keys operable to enter a desired number of copies.

Figure 19:
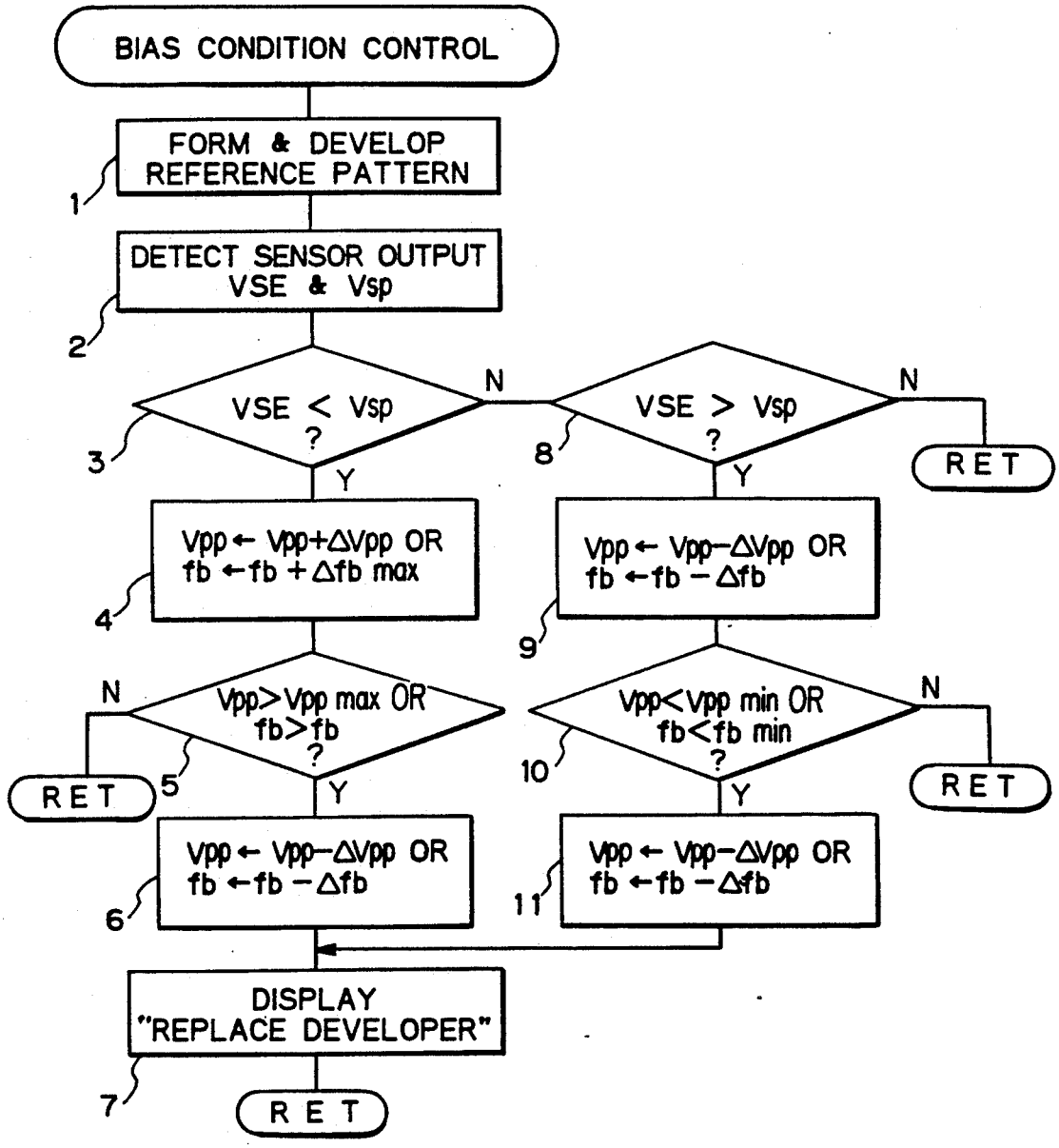

While the embodiment determines whether or not to change the conditions of bias electric field depending on whether or not the degree of edge emphasis lies in the allowable range, whether or not to change them may be determined on the basis of whether or not edge emphasis exists. FIG. 19 shows a specific routine using the latter decision. As shown, after a reference toner image has been formed (step 1), the CPU 31 determines the densities of the edges and central portion of the toner image in response to the output of the sensor 37 and compares the resulting densities VSE and Vsp (steps 3 and 8). If VSE is greater than Vsp, meaning that edge emphasis has occurred (Y, step 3), the CPU 31 increases the peak-to-peak voltage Vpp or the frequency fb of the AC component by a predetermined amount ($\Delta$Vpp or $\Delta$fb). If Vsp is greater than VSE, meaning that sharpness has fallen (Y, step 8), the CPU 31 reduces the voltage Vpp or the frequency fb by a predetermined amount ($\Delta$Vpp or $\Delta$fb). In any case, the CPU 31 determines whether or not the changed Vpp or fb exceeds the limit (upper limit when increased or lower limit when reduced) (steps 5 and 10) and, if the former exceeds the latter, restores the former to the previous value and urges the operator to replace the developer (steps 6, 11 and 7). If desired, the distance between the drum 2 and the developing sleeve may be changed in place of the peak-to-peak voltage Vpp or the frequency fb of the AC component of the bias voltage. This kind of control is capable of coping with both of edge emphasis and the fall of sharpness and is, therefore, advantageously practicable with a developer whose resistance is susceptible to, for example, changes in temperature and humidity.

To determine the degree of edge emphasis or the fall of sharpness, various kinds of calculations are available in place of the calculation of the difference in density between the edges and the central area of a reference toner image for measurement, as follows.

A method as simple as the above-described embodiment is to use a ratio between the outputs VSE and Vsp of the sensor 37 representative of the edges and the central portion of the reference toner image, e.g., Vsp/VSE. With this method, it is possible to determine that the image is desirable when Vsp/VSE is 1, that edge emphasis has occurred when Vsp/VSE is smaller than 1, i.e., when the density is higher at edges than the central portion, or that sharpness has been degraded when Vsp/VSE is greater than 1, i.e., when the density is lower at the edges than at the central portion. The degree of edge emphasis or that of the fall of sharpness can be determined on the basis of the specific value of the ratio.

Figure 20A:
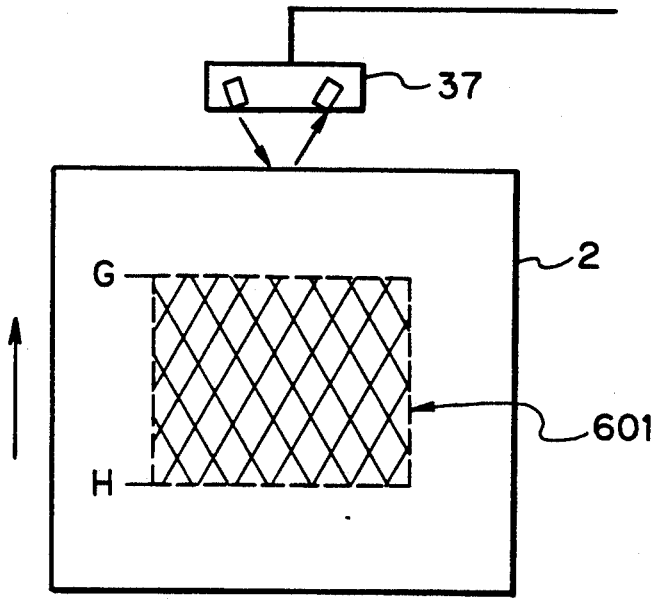
FIG. 20A shows a toner image developed in a desirable condition.
Figure 20B:
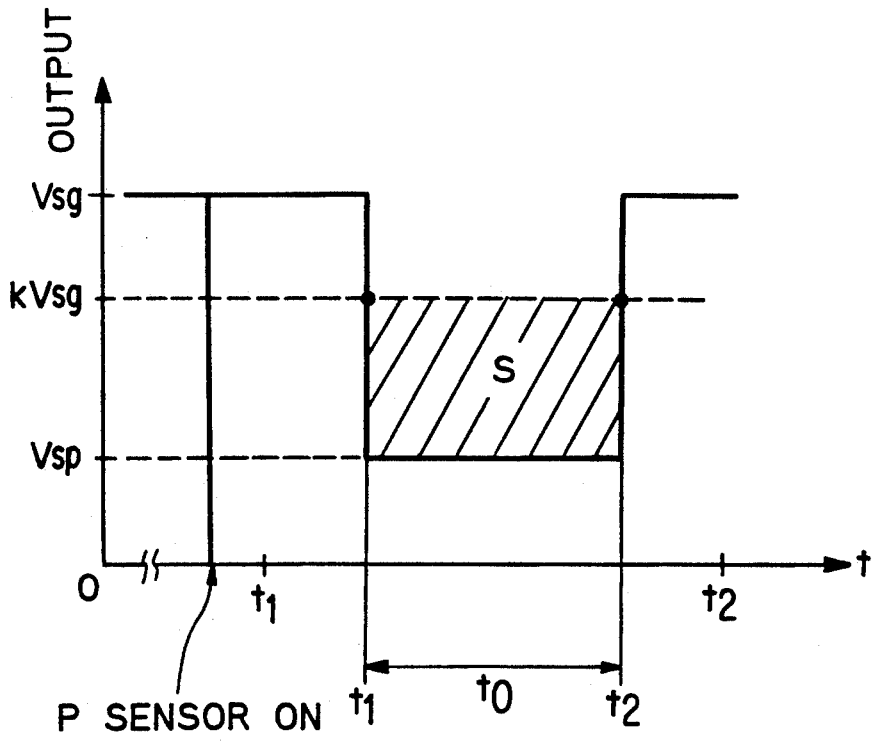
FIG. 20B shows a specific waveform of the output of an optical sensor associated with the toner image of FIG. 20A.
Figure 21A:
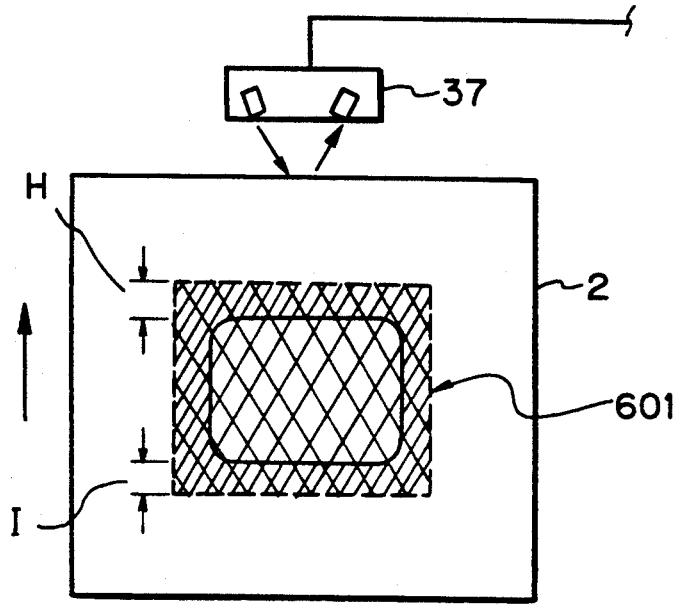
FIG. 21A shows a toner image with emphasized edges.
Figure 21B:
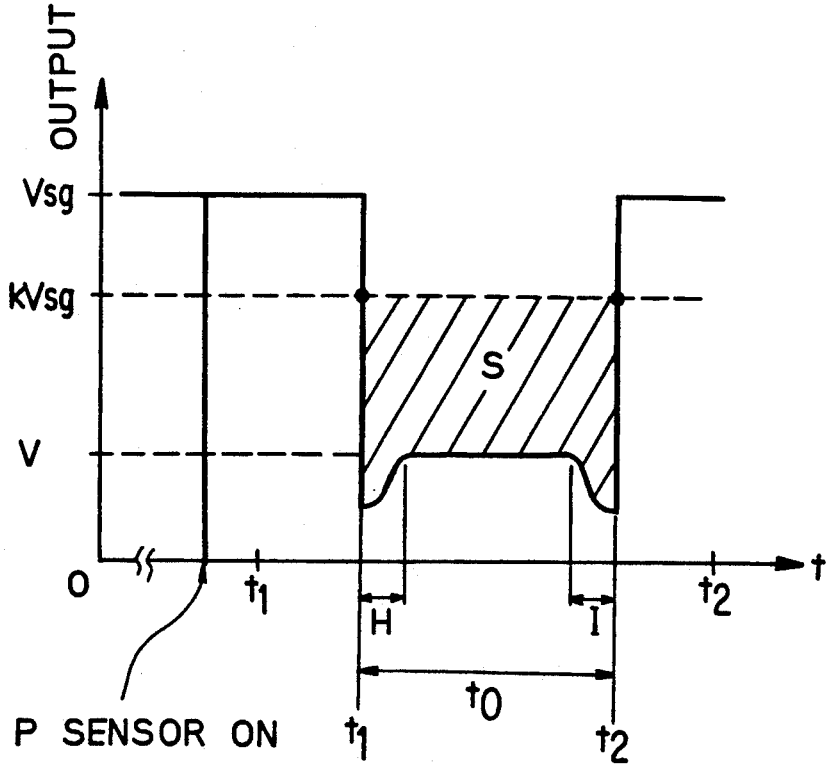
FIG. 21B shows a specific waveform of the output of an optical sensor associated with the toner image of FIG. 21B.
Figure 22A:
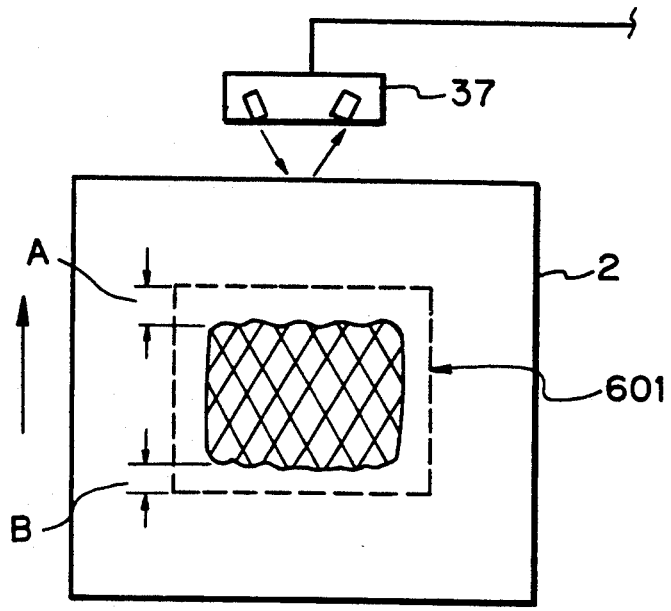
FIG. 22A shows a toner image whose sharpness is lowered at the edges.
Figure 22B:
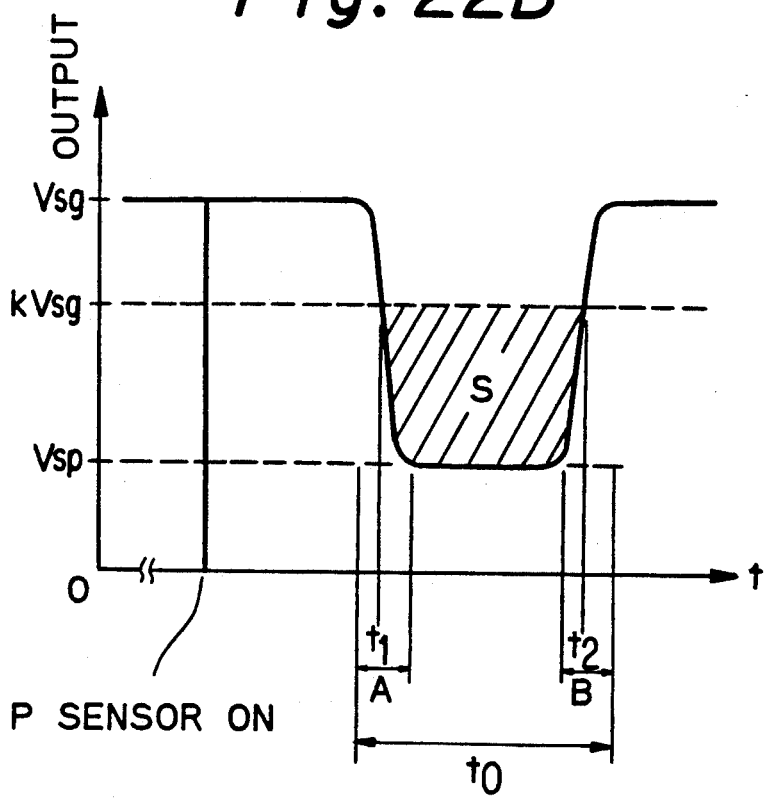
FIG. 22B shows a specific waveform of the output of an optical sensor associated with the toner image of FIG. 22A.

As shown in FIGS. 20A, 20B, 21A, 21B, 22A and 22B, when a reference toner image for measurement is formed and sensed by the sensor 37, the toner deposits on the drum 2 in a different condition in each of the case wherein edge emphasis or the fall of sharpness has not occurred (FIG. 20A), the case wherein edge emphasis has occurred (FIG. 21A), and the case wherein sharpness has fallen at the edges (FIG. 22A). Specifically, in FIG. 20A, the toner deposits evenly on a reference pattern latent image area 601 having a uniform potential, as indicated by double hatching. By contrast, in FIG. 21A, a greater amount of toner deposits on the edges (e.g. regions H and L) of the latent image area 601 than at the central portion. Further, in FIG. 22A, the toner does not deposit on the edges of the latent image area 601 (e.g. regions A and B) or deposits in a smaller amount there than on the central portion, and the edges of the toner deposition area are undularoty or otherwise irregular in shape. FIGS. 20B, 21B and 22B each shows the variation of the sensor output with respect to time. As these figures indicate, the sensor output varies in a different way in each case. Specifically, in FIG. 20B, the sensor output remains the same from the upstream edge G to the downstream edge H of the toner deposition area 601. In FIG. 21B, the sensor output is comparatively low at the edges (H and I) where the amount of toner deposition is comparatively great. Further, in FIG. 22B, the sensor output is comparatively high at the edges (A and B) where the amount of toner deposition is relatively small.

For the reason described above, it is possible to determine in which of the different conditions the toner has deposited by quantizing the condition of toner deposition. For example, assume that the time-integrated sensor value of the sensor output particular to the condition shown in FIG. 20B is a reference value since it is representative of a desirable image. Then, the integrated value is smaller than the reference value in the case of the edge-emphasized toner image shown in FIG. 21 or greater than the reference value in the case of the toner image with poor sharpness shown in FIG. 22B. Therefore, the condition of toner deposition can be quantized on the basis of the integrated value.

Further, FIGS. 20B–22B each shows an area S surrounded by a line indicative of a certain reference level kVsg and a line indicative of the variation of sensor output. Assuming that the integrated value for determining the area S shown in FIG. 20B is a reference value, the integrated value is greater than the reference value in the edge-emphasized image shown in FIG. 21B or greater than the reference value in the less sharp image shown in FIG. 22B. The condition of toner deposition, therefore, can be quantized on the basis of such an integrated value. The above-mentioned area S may be determined by the following equation:

$$S = \int_{t_1}^{t_2} \{kVsg - P(t)\}dt$$

where P (t) denotes the output of the sensor 37, and $t_1$ and $t_2$ each denotes the time when P (t)=holds ($t_1 < t_2$). It is to be noted that assuming the senor output associated with the central portion of a toner image representative of a document is $Vsp_0$ and the ordinary sensor output representative of the background of the drum 2 is $Vsg_0$, k is a constant satisfying a relation $Vsp_0/Vsg_0 < k < 1$, and that Vsg determining the reference level is the sensor output derived from the background and joining in the actual measurement. Whether or not edge emphasis or the fall of sharpness has occurred or the degree thereof can be determined by comparing the area S produced by the above equation and a reference value, e.g., $(kVsg - Vsp) \times t_0$ which is the area S of the desirable toner image (where Vsp and $t_0$ are respectively the sensor output representative of the central portion of the reference toner image and the period of time for the desirable toner image to move away from the sensor, i.e., a value produced by dividing the length of the reference latent image in the moving direction of the drum 2 by the moving speed of the drum 2).

Figure 23:
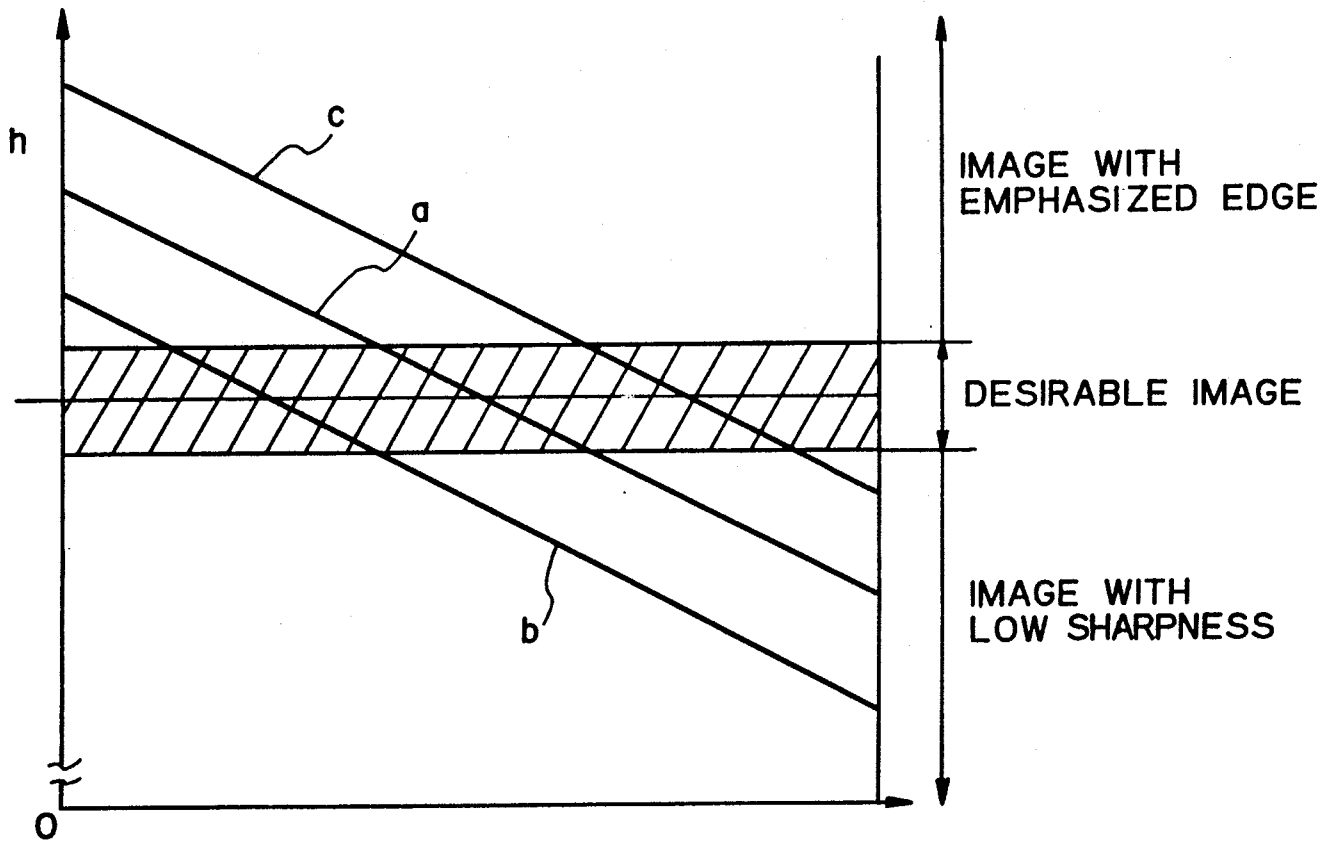
FIG. 23 is a graph showing a peak-to-peak voltage correction range for achieving a desirable image.

Alternatively, a value produced by dividing the area S by the period of time $t_0$ (referred to as h hereinafter) may be compared with the result of calculation (kVsg−Vsp). FIG. 23 shows an adequate range of peak-to-peak voltage which does not accenturate edges or lower the sharpness of edges with respect to a fresh carrier a, a carrier b whose resistance has lowered due to aging, and a carrier c whose resistance has increased due to aging. In FIG. 23, the ordinate and the abscissa indicate respectively the above-mentioned value h and the peak-to-peak voltage of the AC component of the bias voltage. The peak-to-peak voltages corresponding to part of each of the lines a, b and c that crosses the adequate range of h, which is indicated by hatching, define the adequate range thereof. FIG. 23 indicates that the adequate range of peak-to-peak voltage increases with the increase in the resistance of the carrier.

Figure 25:
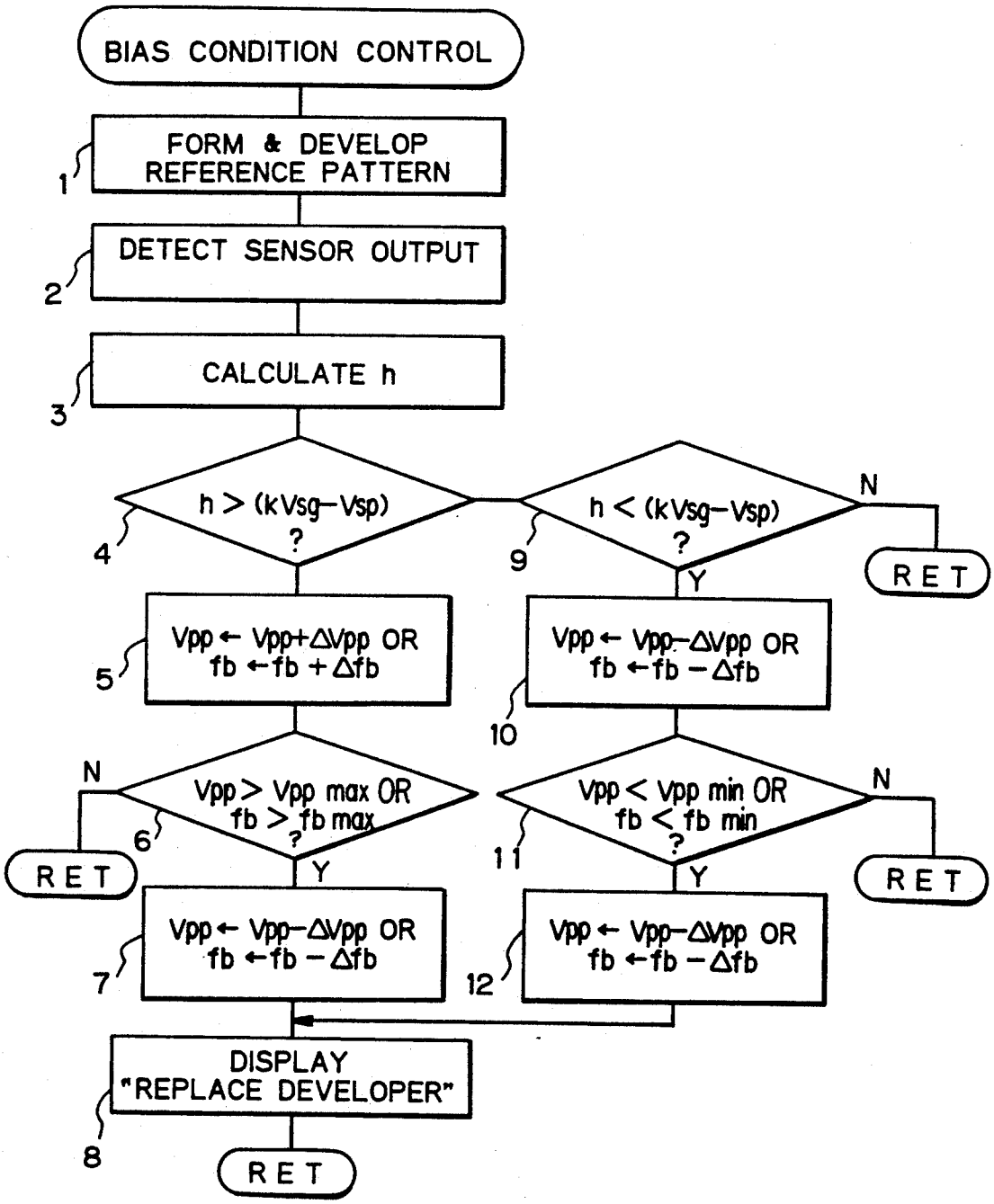
FIG. 25 is a flow chart representative of a still another embodiment of the present invention.

FIG. 25 shows a specific bias condition control procedure using the value h and which is essentially similar to the procedure shown in FIG. 19. The difference is that while the procedure of FIG. 19 determines whether edge emphasis or the fall of sharpness has occurred by comparing VSE and Vsp associated with, respectively, the edges and the central portion of a reference toner image, the procedure of FIG. 25 determines it by calculating h on the basis of the sensor output (steps 2 and 3) and comparing it with (kVsg−Vsp). Specifically, in FIG. 25, when the calculated value h is greater than the result of calculation (kVsg−Vsp), the CPU 31 increases, for example, the peak-to-peak voltage determining that edge emphasis has occurred. On the other hand, when h is smaller than (kVsg−Vsp), the CPU 31 lowers, for example, the peak-to-peak voltage determining that the sharpness of edges has been lowered.

Alternatively, the condition of toner deposition on the reference toner image may be quantized on the basis of the size of the toner deposition area.

Further, regarding a toner image whose edges are not sharp, e.g., the image shown in FIG. 22A, since the toner does not deposit on the edges (A and B in FIG. 22A) or deposits only in a small amount, the size of toner deposition area where more than a certain amount of toner deposits is smaller than the size of the image of FIG. 20A and that of the image of FIG. 21A. Hence, assuming that the previously stated value kVsg is a threshold level, then the sensor output lower than the threshold level continues over a period of time (from $t_1$ to $t_2$), i.e., ($t_2 - t_1$) which is shorter in FIG. 22B than in FIGS. 20B and 21B. This, coupled with the fact that FIGS. 20B and 21B are distinguishable on the basis of whether or not the sensor output representative of edges is lower than the sensor output representative of the central portion, allows the presence/absence and the degree of fall of sharpness to be quantized by the duration of the sensor output lower than the threshold level. Also, the presence/absence and the degree of edge emphasis can be quantized if use is made of the sensor output representative of the edges and the senso output representative of the central portion.

Figure 26:
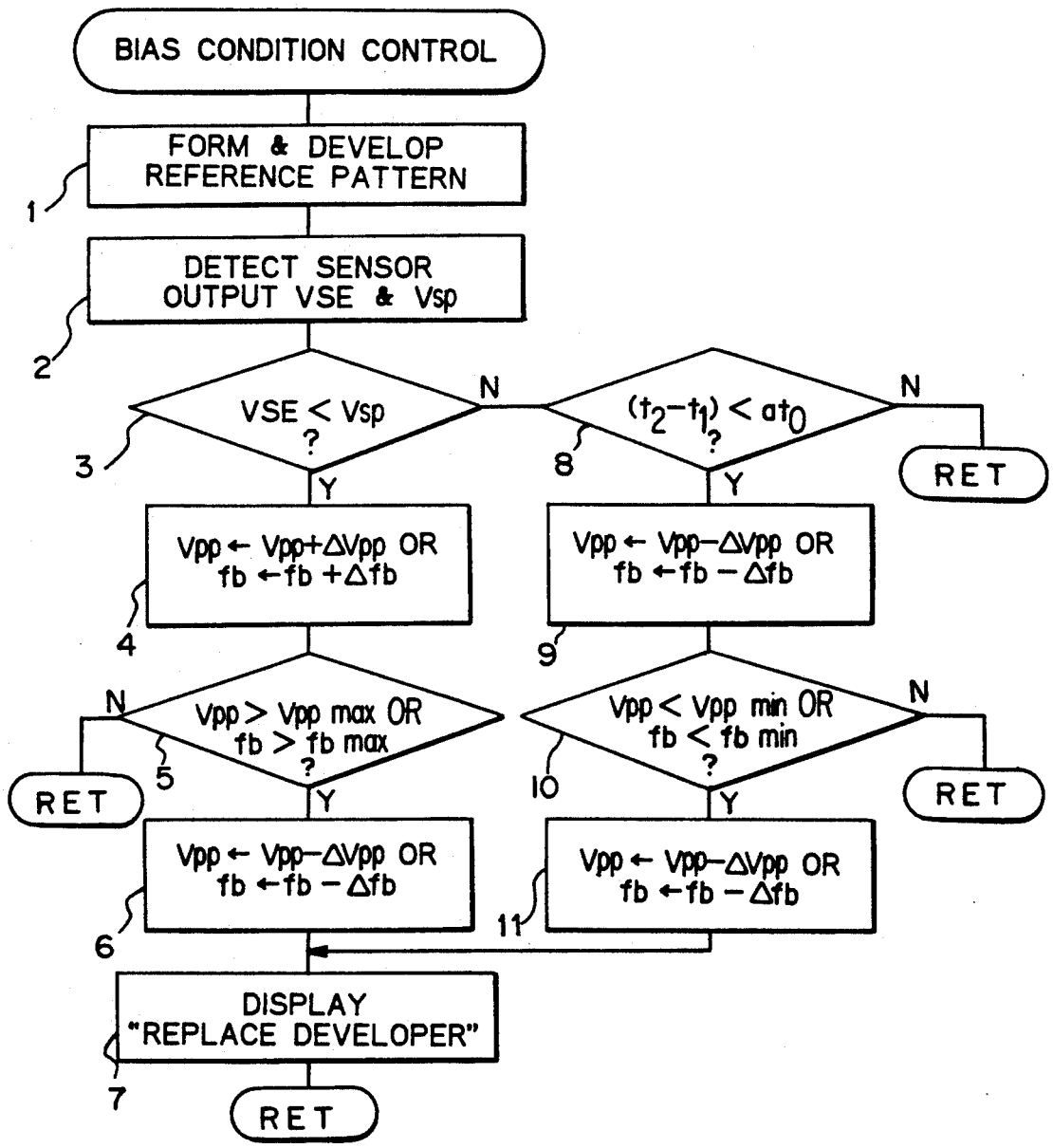
FIG. 26 is a flowchart representative of a further embodiment of the present invention.

FIG. 26 shows a specific bias condition control procedure using the above-stated decision regarding edge emphasis and the fall of sharpness. This control is essentially similar to the control described with reference to FIG. 19. However, the procedure of FIG. 26 executes the decision on edge emphasis by comparing the sensor outputs VSE and Vsp representative of the edges and the central portion, respectively, and the decision on sharpness by comparing the previously stated $(t_2-t_1)$ and $t_0$. Specifically, when VSE is lower than Vsp (Y, step 3), the CPU 31 determines that edge emphasis has occurred and increases, for example, the peak-to-peak voltage. On the other hand, when $(t_2-t_1)$ is smaller than $t_0$ multiplied by a constant a, i.e., $at_0$, the CPU 31 determines that sharpness has been lowered and lowers, for example, the peak-to-peak voltage. The constant a is a coefficient selected by taking account of detection errors and may be greater than zero and smaller than or equal to 1.

Figure 24:
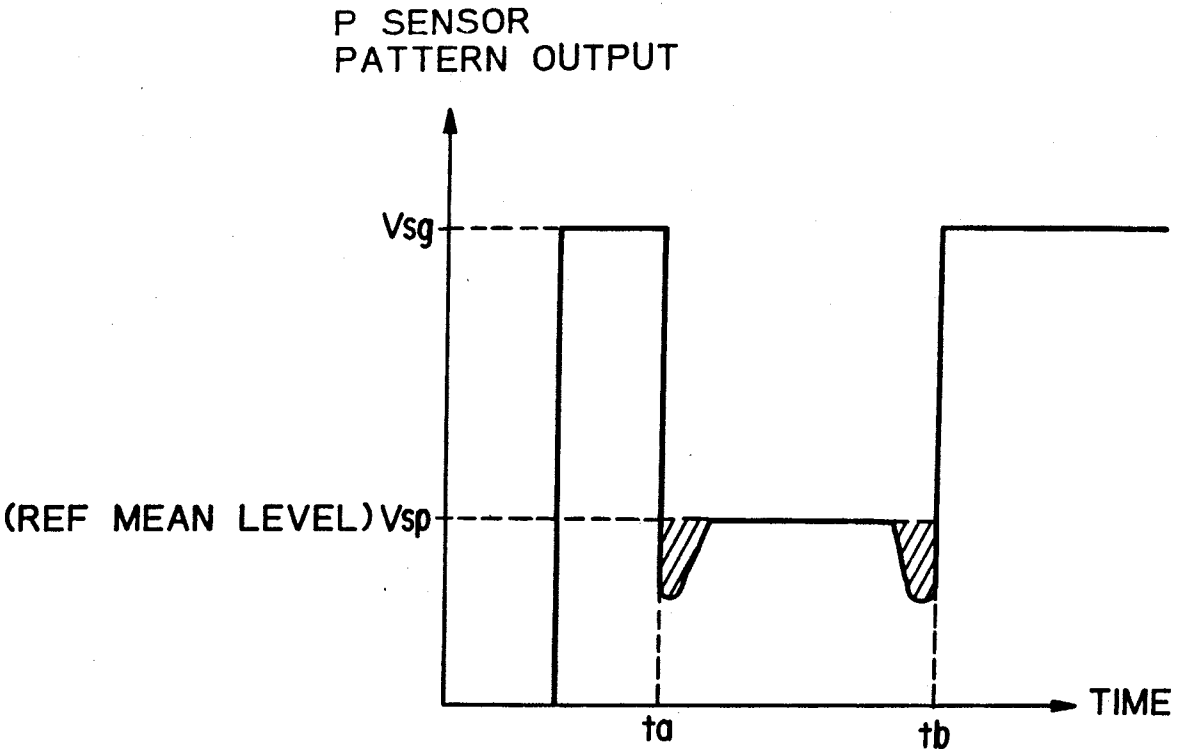
FIG. 24 shows a waveform representative of an output of an optical sensor.

FIG. 24 shows a further approach to quantize the condition of toner deposition on the reference toner image. Specifically, the quantization may be effected by using the area S of regions which are surrounded by a line indicative of the level of sensor output representative of the central portion of the toner image and lines indicative of the variation of sensor output. The area S may be produced by:

$$S = \int_{ta}^{tb} \{Vsp - P(t)\}dt$$

where ta is the time when the upstream edge of the reference toner image faces the sensor 37, tb is the time when the downstream edge faces the sensor 37, Vsp is the sensor output derived from the central portion of the toner image, and P(t) is the sensor output. For Vsp, use may be made of the running average of the central portions of toner images, as in the control of FIG. 7.

The above integration for determining the area S may be replaced with the conventional trapezoidal rule. Then, the accuracy of the area S will increase with the number of sampling points.

While the embodiment has been shown and described as forming a reference latent image on the drum 2 and develop it to produce a reference toner image for measurement, the measurement may be effected with the reference toner image transferred from the drum to the transfer belt 9. The latter is advantageous over the former since edge emphasis and the fall of sharpness can be detected with image quality relatively close to the image quality on a paper sheet. When the sensor 37 senses the reference toner image, the intensity of a reflection and, therefore, the relation between the sensor output and the amount of toner deposition differs from a toner of one color to another. In light of this, the constant, for example, for the calculation may be changed depending on the color of the toner for forming the reference toner image.

An image representative of a photographic image should preferably appear smooth without edge emphasis. However, some degree of edge emphasis or edge enhancement is rather desirable when it comes to line images and characters in order to render the contours sharp. Therefore, the apparatus may be provided with means for distinguishing photographic images and line and character images so as to execute the foregoing control against edge emphasis only when line and character images are to be formed. Of course, the optical sensor 37 is only illustrative and may be replaced with, for example, a potential sensor responsive to the amount of charge deposited on the toner forming a toner image.

In summary, it will be seen that the present invention provides an image forming apparatus which insures an attractive image having sharp edges stably even when the resistance of a developer changes due to aging.

Various modifications will become possible for those skilled in the art after receiving the teachings of the present disclosure without departing from the scope thereof.

What is claimed is:

1. An image forming apparatus comprising:
an image carrier;
latent image forming means for electrostatically forming a latent image on said image carrier;
developing means for conveying a two-component type developer made up of a toner and a carrier to a developing region where a developer carrier faces said image carrier and transfers said developer to said image carrier, and forming a bias electric field for development having an alternating electric field in said developing region to convert said latent image to a toner image;
reference latent image forming means for forming a predetermined reference latent image on said image carrier;
irregularity detecting means for detecting, after said developing means has developed said reference latent image to produce a reference toner image, a degree of difference in density between an edge and a central portion of said reference toner image; and
bias electric field control means for controlling said bias electric field in response to an output of said irregularity detecting means.

2. An apparatus as claimed in claim 1, wherein said irregularity detecting means comprises:
density detecting means for detecting the densities of the edge and central portion of said reference toner image; and
first calculating means for calculating a difference between the densities of the edge and central portion detected by said density detecting means.

3. An apparatus as claimed in claim 1, wherein said irregularity detecting means comprises:
density detecting means for detecting the densities of the edge an central portion of said reference toner image; and
second calculating means for calculating a ratio between the densities of the edge and central portion detected by said density detecting means.

4. An apparatus as claimed in claim 1, wherein said irregularity detecting means comprises:
density detecting means for detecting the densities of various portions of said reference toner image; and
third calculating means for integrating the densities detected by said density detecting means for each of said various portions of said reference toner image.

5. An apparatus as claimed in claim 4, wherein said irregularity detecting means further comprises fourth calculating means for calculating a running average of the densities of the central portion detected by said density detecting means, said third calculating means performing integration with each of the various portions of said reference toner image while subtracting the density detected by said density detecting means from the running average produced by said fourth calculating means.

6. An apparatus as claimed in claim 1, further comprising commanding means for commanding said reference latent image forming means to form said reference latent image, commanding said density detecting means to detect the densities of the edge and central portion of said reference toner image, and commanding said bias electric field control means to control the bias electric field in response to an output of said density detecting means.

7. An apparatus as claimed in claim 1, wherein said bias electric field control means comprises alternating component control means for increasing, when said irregularity detecting means determines that the density of the edge is higher than the density of the central portion by more than a predetermined degree, either of the peak-to-peak voltage and the frequency of an alternating component of a voltage to be applied to a counter electrode member for forming the electric field.

8. An apparatus as claimed in claim 1, wherein said bias electric field control means comprises alternating component control means for reducing, when said irregularity detecting means determines that the density of the edge is lower than the density of the central portion by more than a predetermined degree, either of the peak-to-peak voltage and the frequency of an alternating component of a voltage to be applied to a counter electrode member for forming the electric field.

9. An apparatus as claimed in claim 1, wherein said bias electric field control means comprises distance control means for reducing, when said irregularity detecting means determines that the density of the edge is higher than the density of the central portion by more than a predetermined degree, the distance between said image carrier and a counter electrode member for forming the bias electric field.

10. An apparatus as claimed in claim 1, wherein said bias electric field control means comprises distance control means for increasing when said irregularity detecting means determines that the density of the edge is lower than the density of the central portion by more than a predetermined degree, the distance between said image carrier and a counter electrode member for forming the bias electric field.

11. An apparatus as claimed in claim 1, wherein said bias electric field control means comprises alternating component control means for controlling, when said irregularity detecting means determines that the density of the edge is higher than the density of the central portion by more than a predetermined degree, the duty ratio of an alternating component of a voltage to be applied to a counter electrode member for forming the bias electric field toward 1:1.

12. An apparatus as claimed in claim 1, wherein said bias electric field control means comprises alternating component control means for controlling, when said irregularity detecting means determines that the density of the edge is lower than the density of the central portion by more than a predetermined degree, the duty ratio of a voltage to be applied to a counter electrode member for forming the bias electric field away from 1:1.

13. An apparatus as claimed in claim 1, wherein said reference latent image forming means is constructed to form a reference latent image in which a first potential portion and a second potential portion higher in voltage than said first potential portion adjoin each other;

said irregularity detecting means being constructed to detect, after said developing means has developed said reference latent image to produce a reference toner image having a first and a second region corresponding respectively to said first potential portion and said second potential portion, a degree of difference between the density of one of the adjoining edges of said first and second regions which is developed in a comparatively low density and the density of the central portion of said reference toner image containing said one edge.

14. An apparatus as claimed in claim 1, wherein said reference latent image forming means is constructed to form a reference latent image having two portions each having a particular potential;

said irregularity detecting means being constructed to detect, after said developing means has developed said reference latent image to produce a reference toner image having two regions each having a particular density, a degree of difference between the density of the edges and the density of the central portion of each of said two regions.

15. An image forming apparatus comprising:

an image carrier;

latent image forming means for electrostatically forming a latent image on said image carrier;

developing means for conveying a two-component type developer made up of a toner and a carrier to a developing region where a developer carrier faces said image carrier and transfers said developer to said image carrier, and forming a bias electric field for development having an alternating electric field in said developing region to convert said latent image to a toner image;

reference latent image forming means for forming a predetermined reference latent image on said image carrier;

reference toner image detecting means for detecting the size of a reference toner image which said developing means has produced by developing said reference latent image; and bias electric field control means for controlling the bias electric field in response to said reference toner image detecting means.

16. An apparatus as claimed in claim 15, wherein said reference toner image comprises a toner image formed on said image carrier by said developing means and then transferred to an intermediate transfer body.

17. An image forming apparatus comprising:

an image carrier;

latent image forming means for electrostatically forming a latent image on said image carrier;

developing means for conveying a two-component type developer made up of a toner and a carrier to a developing region where a developer carrier faces said image carrier and transfers said developer to said image carrier, and forming a bias electric field for development having an alternating electric field to convert said latent image to a toner image;

deterioration detecting means for detecting a degree of deterioration of said developer; and bias electric field control means for controlling the frequency of the bias electric field in response to said deterioration detecting means.

18. An apparatus as claimed in claim 17, wherein said deterioration detecting means comprises resistance detecting means for detecting the electric resistance of said developer.

* * * * *